US006223667B1

(12) United States Patent
Ono et al.

(10) Patent No.: US 6,223,667 B1
(45) Date of Patent: May 1, 2001

(54) BELT-LOOP SEWING MACHINE

(75) Inventors: Yasushi Ono; Yutaka Hirasawa; Tomio Nii, all of Tokyo (JP)

(73) Assignee: Juki Corporation, Tokyo (JP)

( * ) Notice: Subject to any disclaimer, the term of this patent is extended or adjusted under 35 U.S.C. 154(b) by 0 days.

(21) Appl. No.: 09/366,474

(22) Filed: Aug. 3, 1999

(30) Foreign Application Priority Data

Aug. 3, 1998 (JP) ..... 10-219058

(51) Int. Cl.[7] ..... D05B 21/00; D05B 35/06
(52) U.S. Cl. ..... 112/470.34
(58) Field of Search ..... 112/470.34, 475.06, 112/475.04, 475.07, 475.09, 470.01, 470.03, 470.04, 470.05, 470.06, 470.16

(56) References Cited

U.S. PATENT DOCUMENTS 4,502,399 * 3/1985 Seaman ..... 112/104 X
5,588,384 * 12/1996 Miyachi et al. ..... 112/475.06
5,673,639 * 10/1997 Miyachi et al. ..... 112/470.34
5,974,996 * 11/1999 Nozaki et al. ..... 112/470.04

* cited by examiner

*Primary Examiner*—Peter Nerbun
(74) *Attorney, Agent, or Firm*—Morgan & Finnegan, L.L.P.

(57) ABSTRACT

A belt-loop sewing machine which is capable of efficiently supplying belt loops, includes a bending-shaft-movement-locus control means which controls such that a forward movement locus GML, through which paired bending shafts of a loop supply means are moved toward a sewing position, and a backward movement locus BML, through which the paired bending shafts are moved apart from the sewing position, are made to be different from each other.

6 Claims, 21 Drawing Sheets

BELT-LOOP SEWING MACHINE

BACKGROUND OF THE INVENTION

1. Field of the Invention

The present invention relates to a belt-loop sewing machine which is capable of efficiently supplying a belt loop to a sewing position.

2. Description of the Related Art

As disclosed in U.S. Pat. No. 5,588,384, a belt-loop sewing machine has been known which is capable of sewing a multiplicity of belt loops through which a belt is allowed to pass through, onto the waist of a variety of sewed products, such as jeans and skirts. In general, the belt-loop sewing machine is provided with a belt-loop supply unit for automatically supplying the belt loop to the sewing position.

A conventional belt-loop sewing machine 1 shown in FIG. 20 incorporates a machine body 2 and a belt-loop supply unit 3.

The machine body 2 is a cycle machine having two needles and incorporating a needle plate 9 disposed on the upper surface of a machine bed 5. Two parallel needles 7 disposed in the lengthwise direction of a machine arm 6 are joined to a needle bar 8 allowed to vertically be moved by a known needle-bar moving mechanism (not shown) which is operated in synchronization with rotations of an upper shaft. The machine arm 6 is provided with a known cloth retaining unit (not shown) for supporting two presser feet 10,10 vertically movable up and down relative to a needle plate 9. Thus, the waist portion of trousers or the like placed to surround the machine bed 5 can be held between the each presser feed 10, 10 and the needle plate 9.

An operator faces a free end of the machine arm 6 of the machine body 2 when the operator performs the sewing operation. The free end is defined an operator side OS and opposite side is defined a back side BS for convenience. The belt-loop supply unit 3 is disposed in the right-side portion when it is viewed from the operator side OS of the machine body 2. The machine body 2 and the belt-loop supply unit 3 are disposed on a sewing table (not shown).

The belt-loop supply unit 3 has a tape supply means 13 for delivering an elongated tape 12 for forming belt-loop from the back side BS to the operator side OS in the lengthwise direction of the machine body 2. Then, the tape supply means 13 cuts the delivered tape 12 at its proximal end to have a predetermined length so as to form a belt-loop. Moreover, the belt-loop supply unit 3 has a loop supply means 20 which holds portions adjacent to the two ends of the belt-loop having the predetermined length to bend the ends of the belt-loop and moves the belt-loop to the sewing position of the machine body 2.

The tape supply means 13 incorporates a tape delivery frame 14 on which the tape 12 delivered from a tape supply source (not shown) is placed on the upper surface thereof. A delivery roller 15 serving as a tape delivering means is disposed above the tape delivery frame 14. The delivery roller 15 can be brought into contact with the upper surface of the tape 12.

The delivery roller 15 is formed in a disc-like shape having an outer surface provided with a plurality of teeth 16 for delivering the tape 12. The delivery roller 15 is rotated/stopped by a tape delivering motor (not shown). A tape cutting means 17 is disposed at a position adjacent to the leading end of the tape delivery frame 14 disposed downstream (indicated with an arrow B shown in FIG. 20) in a direction in which the tape 12 is delivered, the tape cutting means 17 being structure to cut the base portion of the tape 12 to form a belt-loop (not shown) having a predetermined length. The tape cutting means 17 incorporates a movable blade 17*a* which is usually disposed above the movement passage for the tape 12 and which is able to move vertically by a cutting drive means (not shown), such as a cylinder, after the tape 12 has been fed for a predetermined length. Moreover, the tape cutting means 17 incorporates a fixed blade (not shown) disposed below the movement passage for the tape 12.

A pair of front and rear L-like shaped tape receiving members 18 are, as a tape support means, disposed to support, from lower sides, the belt-loop having the predetermined length supplied by the delivery roller 15 of the tape supply means 13. The position supported by the tape receiving members 18 is called a belt-loop forming position P4. A guide rod 19 having a lower portion bent into an L-shaped is disposed between the tape receiving members 18. The guide rod 19 aligns the side edge of the tape 12 supplied to the belt-loop forming position to a predetermined position. When the two ends of the belt-loop cut to have the predetermined length are bent by a leading end 21*a* of a bending shafts 21 to be described later, the guide rod 19 prevents deviation of the bent portions, that is, causes the bent portions to completely be superimposed.

The loop supply means 20 has right and left bending shafts 21 each having a forked leading end 21*a*. Each of the bending shafts 21 can be rotated around the axis thereof and moved in the axial direction by a fork drive means (not shown), such as an air cylinder. The leading ends 21*a* of the binding shafts 21 hold end portions of the belt-loop held by the tape receiving members 18 with the predetermined length. Then, the bending shafts 21 are rotated downwards to bend the end of the belt-loop by an angular degree of 180°. Then, the bending shafts 21 are moved forward so that the belt-loop is positioned to the sewing position. The leading ends 21*a* of the bending shafts 21 are always disposed at retracting positions apart from the belt-loop forming position P4 to the right side when the leading ends 21*a* are viewed from a position adjacent to the operator side OS.

The tape delivery frame 14 is provided with a thickness detecting means 22 for detecting a stepped portions or the like of the tape 12 and whether or not a tape 12 has been placed on the tape delivery frame 14.

The conventional belt-loop sewing machine 1 structured as described above causes the tape 12 to be delivered from the upper surface of the tape delivery frame 14 to the belt-loop forming position P4 owing to the rotations of the delivery roller 15. Then, the tape 12 is supported by the tape receiving members 18 from lower side. At this time, the thickness detecting means 22 detects the stepped portion of the tape 12 which is moving on the tape delivery frame 14 to remove the failed belt-loop, and whether or not the tape 12 exists to urge the supply of the tape 12.

Then, the tape 12 delivered by the guide rod is moved and aligned to the standing portions of the tape receiving members 18. Then, the bending shafts 21 are moved forward toward the belt-loop forming position so that the tape 12 is inserted into a forked portion at the leading ends 21*a* of the bending shafts 21. Then the tape cutting means 17 cuts the proximal end of the tape 12 so that a belt-loop having the predetermined length is formed.

Then, the bending shafts 21 are rotated such that the two ends of the belt-loop are bent by an angular degree of 180°. Then, the bending shafts 21 are moved in the axial direction so as to move the belt loop from the belt-loop forming position to the sewing position on a sewed product S. Then, the presser feet 10 are moved downwards to press the sewed product S and the two end bent portions of the belt loop against the needle plate 9. Then, the bending shafts 21 are moved rearwards so as to be removed from the belt loop. Then, the upper surfaces of the two end bent portions of the belt loop are sewed so that the belt loop is sewed onto a predetermined position of the sewed product S.

After the bending shafts 21 have been moved rearwards, the bending shafts 21 are rotated inversely to restore the initial state of the bending shafts 21. Then, a subsequent operation similar to the foregoing operation is performed so as to form a belt loop which must be sewed next. Then, the bending shafts 21 are brought to be on standby at a standby position which is in front of the sewing position.

The foregoing conventional belt-loop sewing machine is in a state that the tape 12 has been delivered to the belt-loop forming position during forward movement of the bending shafts 21 in the axial direction to move the belt loop to the sewing position. Since the bending shafts 21 are moved forwards and rearwards in the axial direction through the same passage, the bending shafts 21 are brought into contact with the tape 12 which has been delivered to the belt-loop forming position. Therefore, the tape 12 is loosened or deviation of the position occurs. As a result, when the tape 12 is cut, the tape 12 cannot be cut to have the predetermined length. The lengths of the belt loops cannot be made consistently. The tape 12 cannot be sometimes inserted into the space between the forks at the leading ends 21*a* of the bending shafts 21. In this case, the belt loop cannot be formed.

SUMMARY OF THE INVENTION

In view of the foregoing, an object of the present invention is to provide a belt-loop sewing machine which is capable of efficiently and reliably supplying a belt loop sewing machine position.

To achieve the foregoing object, according to claim 1 of the present invention, there is provided a belt-loop sewing machine having a belt-loop supply unit structured to cut an elongated tape into sectioned tapes, each having a predetermined length, and incorporating paired forks which fold back the two ends of the sectioned tape toward the center of the tape to form and a hold a belt loop so as to supply the belt loop held by the forks to a sewing position so that the two folded portions of the belt loop are sewed on a workpiece at the sewing position, said belt-loop sewing machine comprising:

movement-locus control means for controlling such that a forward movement locus of said forks which move from a retracting position to the sewing position via a belt-loop forming position and a backward movement locus of said forks which move from the sewing position to the retracting position are different from each other.

Said movement-locus control means compraises, a regulating member for regulating the movement locus of said forks, drive means for displacing said regulating member, and control means for driving said drive means to displace said regulating member during the forward and backward movements of said forks so that the foregoing object is achieved.

Said regulating member including a cam for guiding the movement of said forks so that the foregoing object is achieved.

The backward movement locus of said forks is a movement locus for bypassing the belt-loop forming position so that the foregoing object is achieved.

To achieve the foregoing object, according to the present invention, there is provided a belt-loop sewing machine having a belt-loop supply unit structured to cut an elongated tape into sectioned tapes each having a predetermined length and having paired forks which fold back the two ends of the sectioned tape toward the center of the tape to form and hold a belt loop so as to transport the belt loop held by the forks to a sewing position so that the belt loop is sewed on a sewed product at the sewing position, said belt-loop sewing machine comprising:

means connected to said forks to regulate a forward movement locus of said forks from a retracting position to the sewing position via a belt-loop forming position and to regulate a backward movement locus of said forks from the sewing position to the retracting position.

Said regulating means includes a cam for guiding the movement of said forks so that the foregoing object is achieved.

The backward movement locus of said forks is a movement locus for bypassing the belt-loop forming position so that the foregoing object is achieved.

To achieve the foregoing object, according to the present invention, there is provided a belt-loop sewing machine having a belt-loop supply unit structured to cut an elongated tape into sectioned tapes each having a predetermined length and having a pair of forks which fold back the two ends of the tape toward the middle of the tape to form and hold a belt loop so as to move the belt loop held by the forks to a sewing position so that the belt loop is sewed on a workpiece at the sewing position, said belt-loop sewing machine comprising:

said forks moving from a retracting position to the sewing position via a belt-loop forming position, and then moving from the sewing position to a standby position bypassing the belt-loop forming position.

As a result of with the foregoing structures, undesirable contact between the paired bending shafts and another moving member, for example, a tape supply means or the tape which is supplied to the belt-loop forming position by the tape supply means can easily be prevented during the rearward movement of the paired bending shafts. Therefore, the tape can be supplied to the belt-loop forming position during the rearward movement of the paired bending shafts. As a result, the cycle time for supplying the belt loops to the sewing position can be shortened. Thus, the belt loops can efficiently be supplied to the sewing position.

DESCRIPTION OF THE PREFERRED EMBODIMENTS

Figure 1:
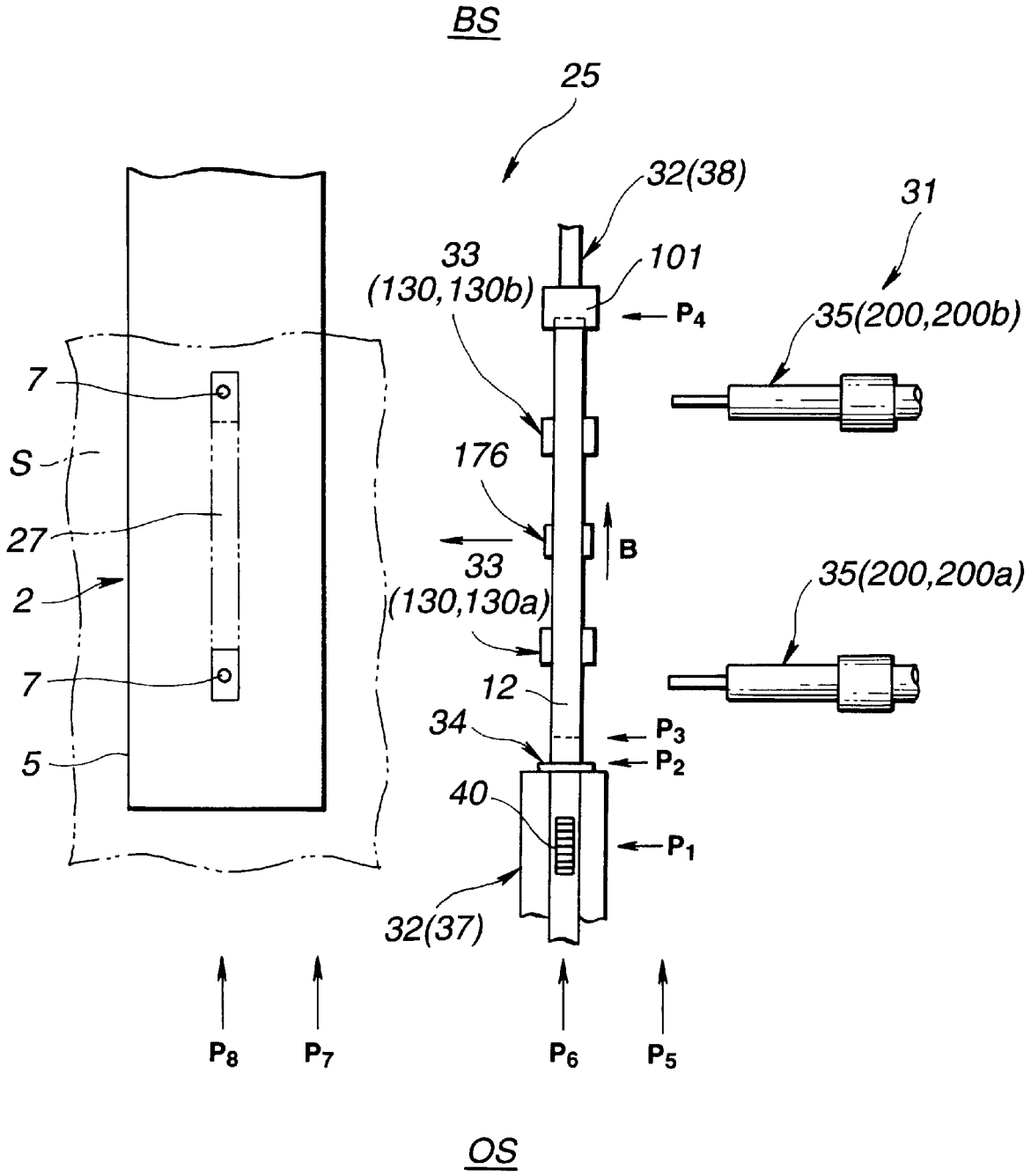
FIG. 1 is a schematic view showing an essential portion of an embodiment of a belt-loop sewing machine according to the present invention when the belt-loop sewing machine is viewed from an upper position.

An embodiment of the present invention will now be described with reference to the drawings. The same and similar elements to those of the above-mentioned conventional structure are given the same reference numerals.

Figure 2:
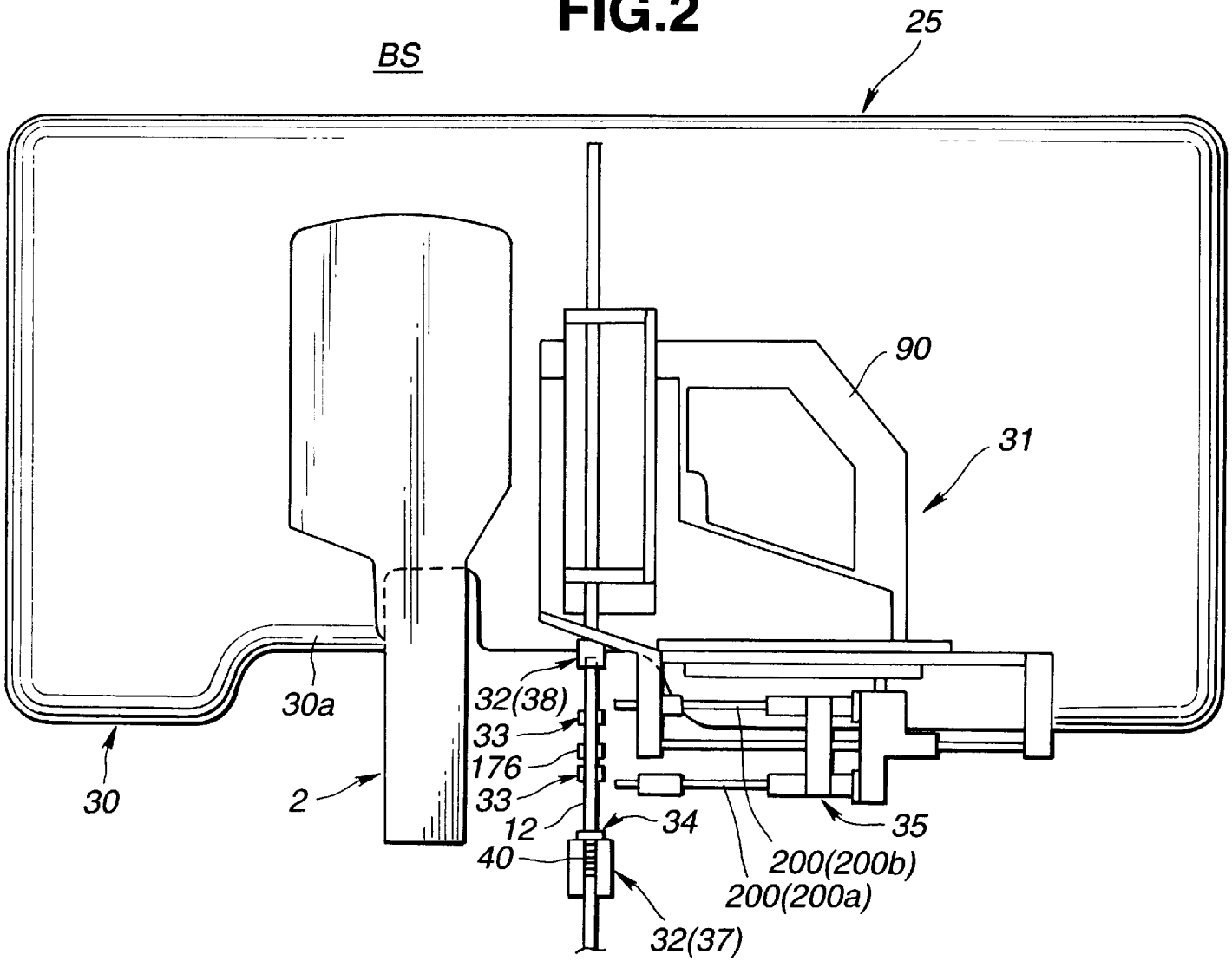
FIG. 2. shows a schematic plan view showing an essential portion of the embodiment of the belt-loop sewing machine according to the present invention.
Figure 16:
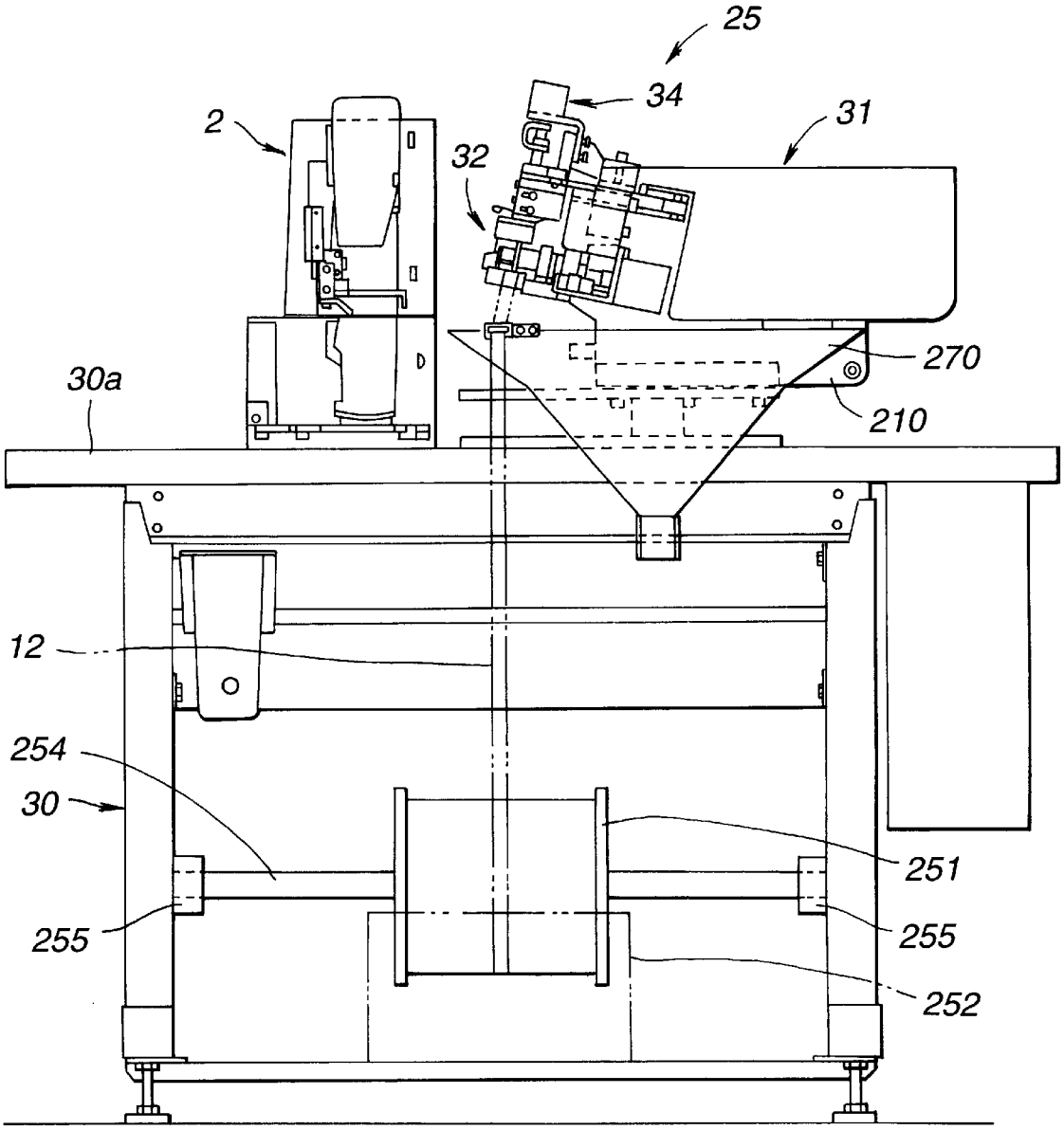
FIG. 16 shows a front view showing a tape supply passage of the embodiment of the belt-loop sewing machine according to the present invention when the passage is viewed from a position adjacent to the operation side.
Figure 17:
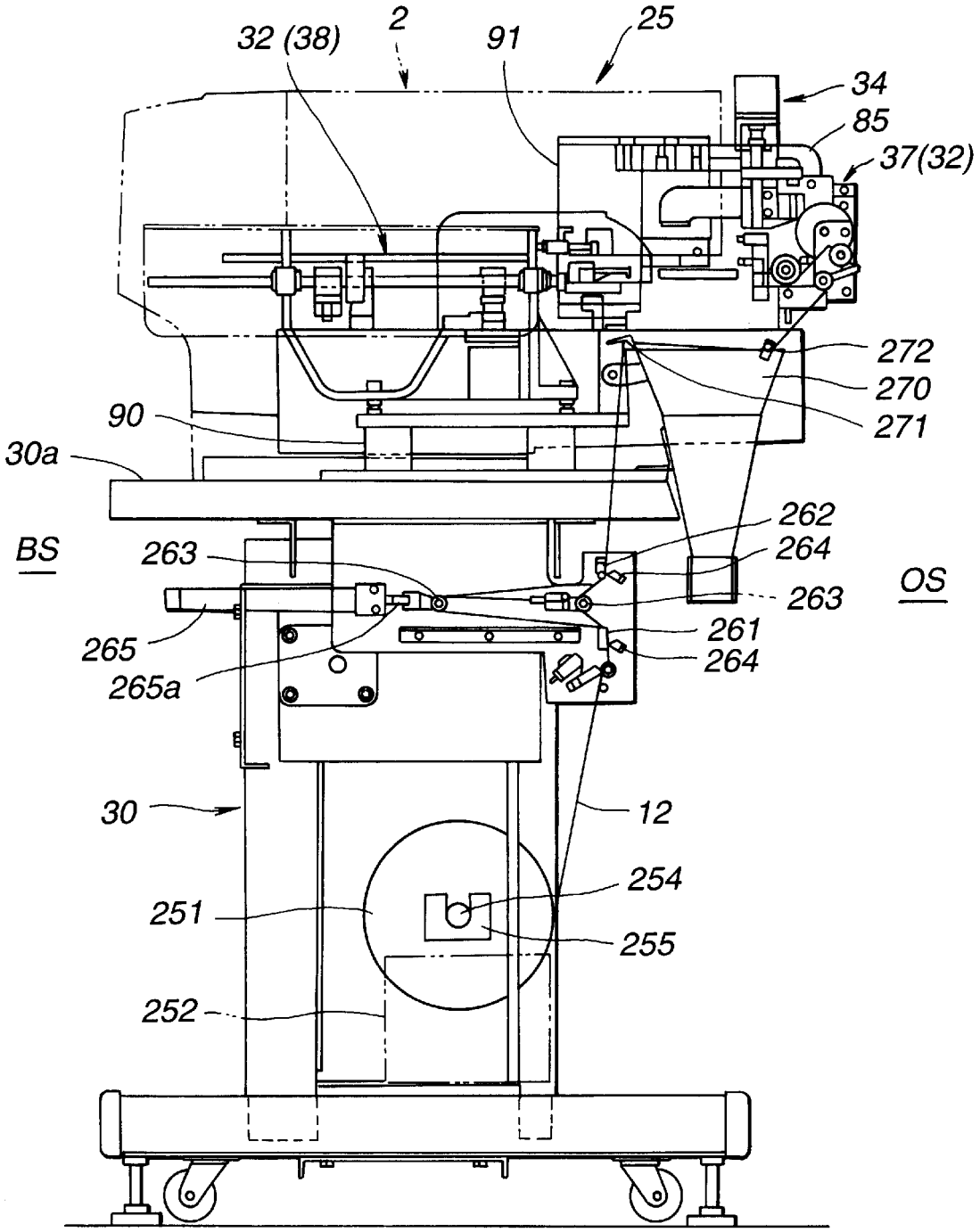
FIG. 17 shows a partially-cut left side view of FIG. 16.

As shown in FIGS. 2, 16 and 17, a belt-loop sewing machine 25 according to this embodiment comprises a machine body 2 being a two-needle cycle machine similarly to the foregoing conventional machine; and a belt-loop supply unit 31 disposed to the right of the machine body 2. The machine body 2 and the belt-loop supply unit 31 are disposed on a substantially flat table surface 30*a* of a sewing table 30. As described above, the free end side of the machine body 2 is defined operator side OS because an operator faces the foregoing side. The opposite side is defined a back side BS.

The belt-loop supply unit 31 is disposed on a base 90 secured to a table surface 30*a* of the table 30. The belt-supply unit 31 includes tape supply means 32, tape support means 33, tape cutting means 34 and loop supply means 35.

Figure 6:
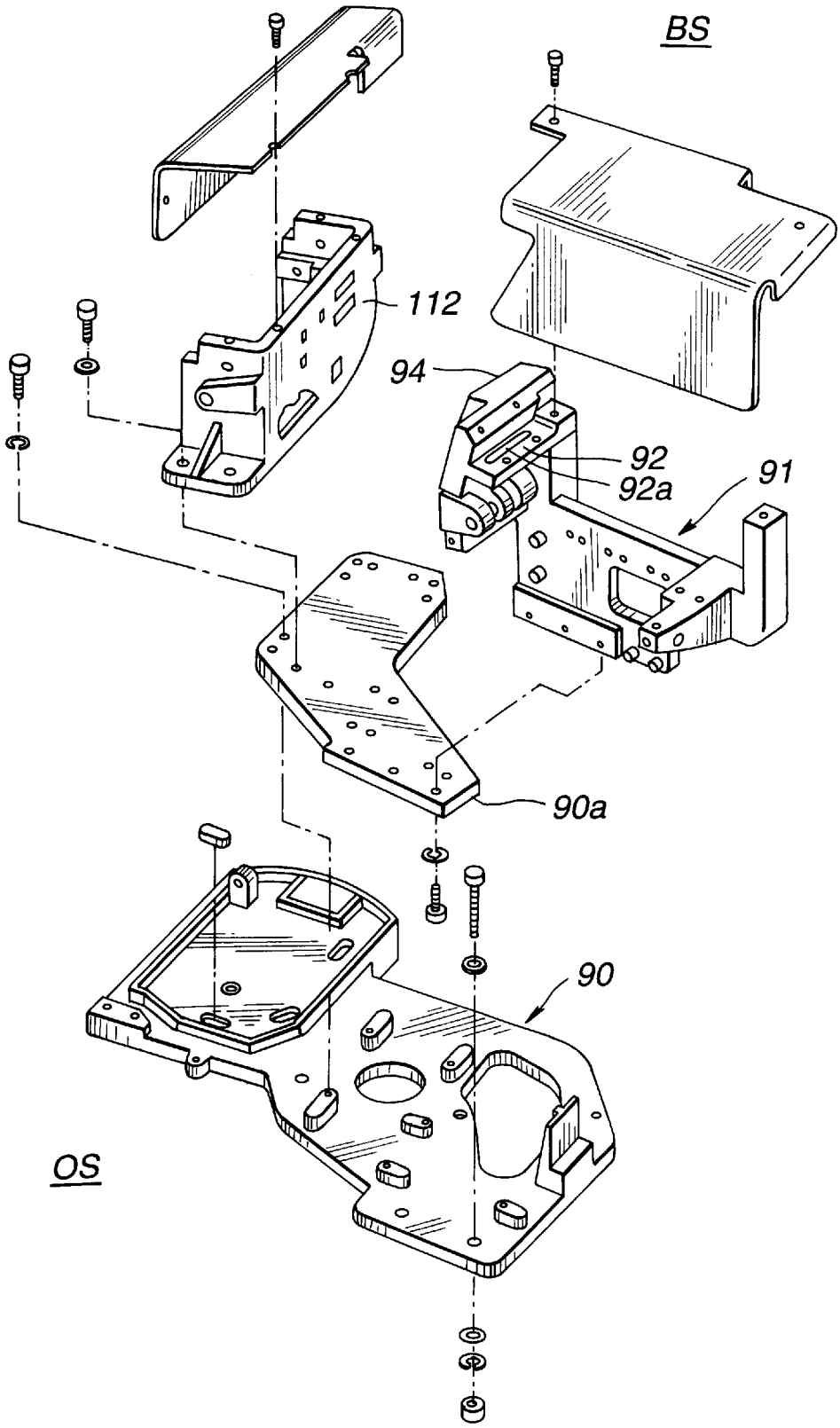
FIG. 6 shows an exploded perspective view showing a base of the embodiment of the belt-loop sewing machine according to the present invention.

Referring to FIG. 6, a support plate 90*a* is secured to the upper surface of the base 90. A joining base 91 and a drawing frame 112 are secured to the upper surface of the support plate 90*a*.

The tape supply means 32 supplies an elongated tape 12 to a belt-loop forming position P4 on the right-hand side of the machine body 2 as viewed in FIG. 1. The tape supply means 32 supplies the tape 12 in a direction from the operator side OS to the back side BS (indicated with an arrow B). Then, the tape support means 33 supports the tape 12 from a lower side. Then, the tape cutting means 34 cuts the proximal end of the tape 12 so that a tape (a belt loop 27) having a predetermined length is formed. Then, the loop supply means 35 downwardly folds back the two end portions of the tape (the belt loop 27) on itself toward the center of the tape at the foregoing position, holds the tape, and then, transports the tape to a sewing position P8.

As shown in FIG. 1, the tape supply means 32 incorporates a tape delivering means 37 and a tape drawing means 38 disposed opposite to each other along the right side of the machine body 2 and apart from each other for a predetermined distance.

The tape delivering means 37 delivers the tape 12 in the right side of the machine body 2 to cause the tape 12 to be moved in the lengthwise direction of the machine body 2. Thus, the tape 12 is delivered in a delivering direction from the operator side OS to the back side BS (as indicated with an arrow B shown in FIGS. 1 and 3). The tape delivering means 37 is disposed upstream in the delivering direction.

Figure 4:
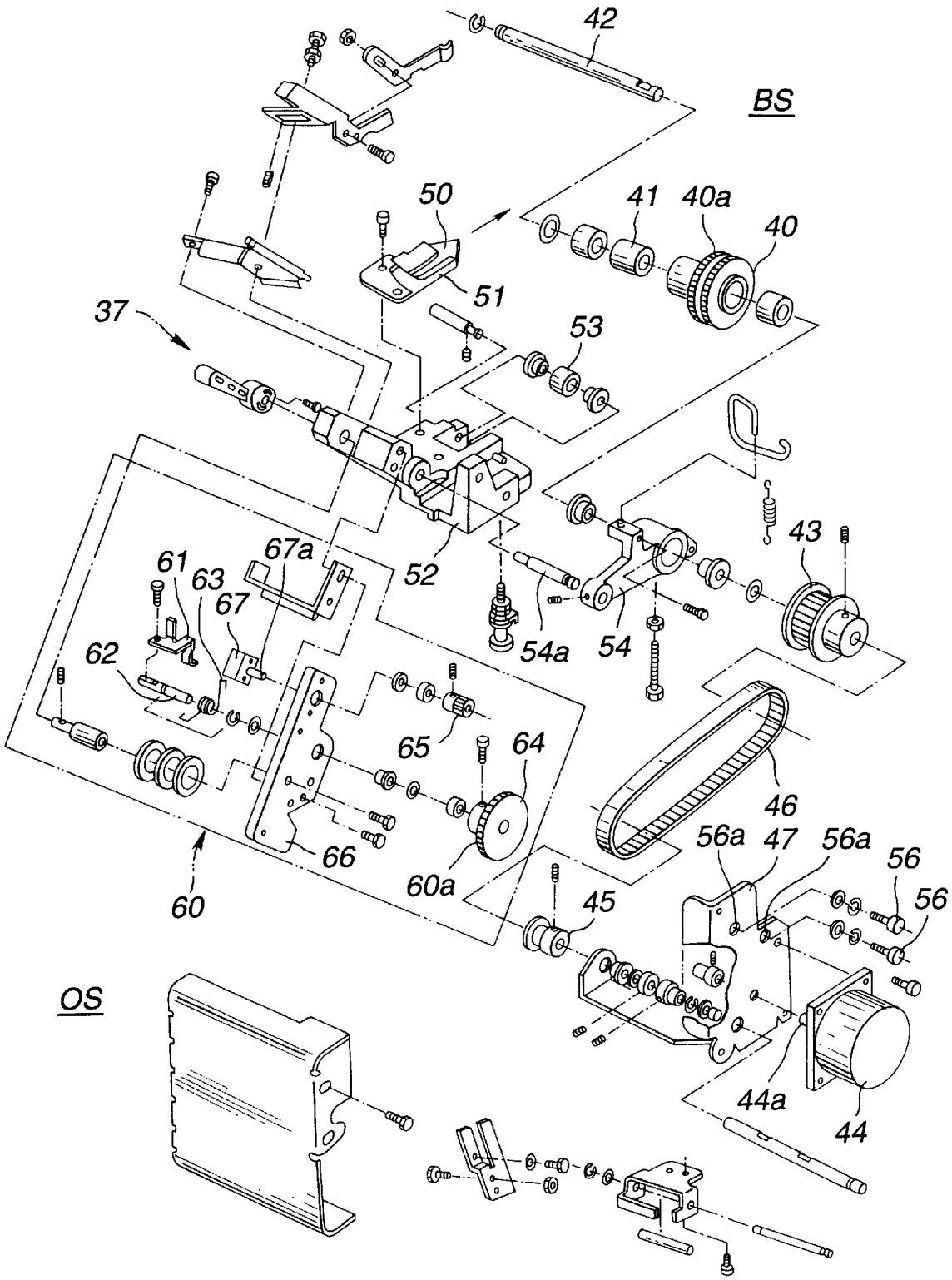
FIG. 4 shows an exploded perspective view showing an essential portion of a tape delivering means of the embodiment of the belt-loop sewing machine according to the present invention.

The tape delivering means 37 has a structure as shown in FIG. 4.

A rotative shaft 42 is disposed substantially horizontally in a direction perpendicular to the direction in which the tape 12 is delivered. A delivering roller 40 is joined to one end of the rotative shaft 42 through a one-way clutch 41 so disposed as to be rotated only to the direction in which the tape 12 is delivered. A follower timing-belt pulley 43 is joined to the other end of the rotative shaft 42. The delivering roller 40 has two disc-shape gears each having a plurality of feeding teeth 40*a* formed on the overall outer surface thereof, the two gears being integrally molded at positions apart from each other for a predetermined distance in the axial direction.

The follower timing-belt pulley 43 forms a pair in association with a drive timing-belt pulley 45 joined to an output shaft 44*a* of a tape delivering motor 44, for example a stepping motor. The rotations of the tape delivering motor 44 is transmitted to the rotative shaft 42 through a timing belt 46 arranged between two timing-belt pulleys 43 and 45 to cause the rotations of the delivering roller 40. The tape delivering motor 44 is electrically connected to a control means 48 (see FIG. 18) to be described later. Thus, the tape delivering motor 44 is rotated at predetermined timing in accordance with a control command output from the control means 48.

Although the delivering roller 40 according to this embodiment has the structure with the feeding teeth 40*a* formed on the outer surface thereof, the outer surface may have, for example, knurling formed thereon, rubber disposed thereon or a flat surface.

Figure 5:
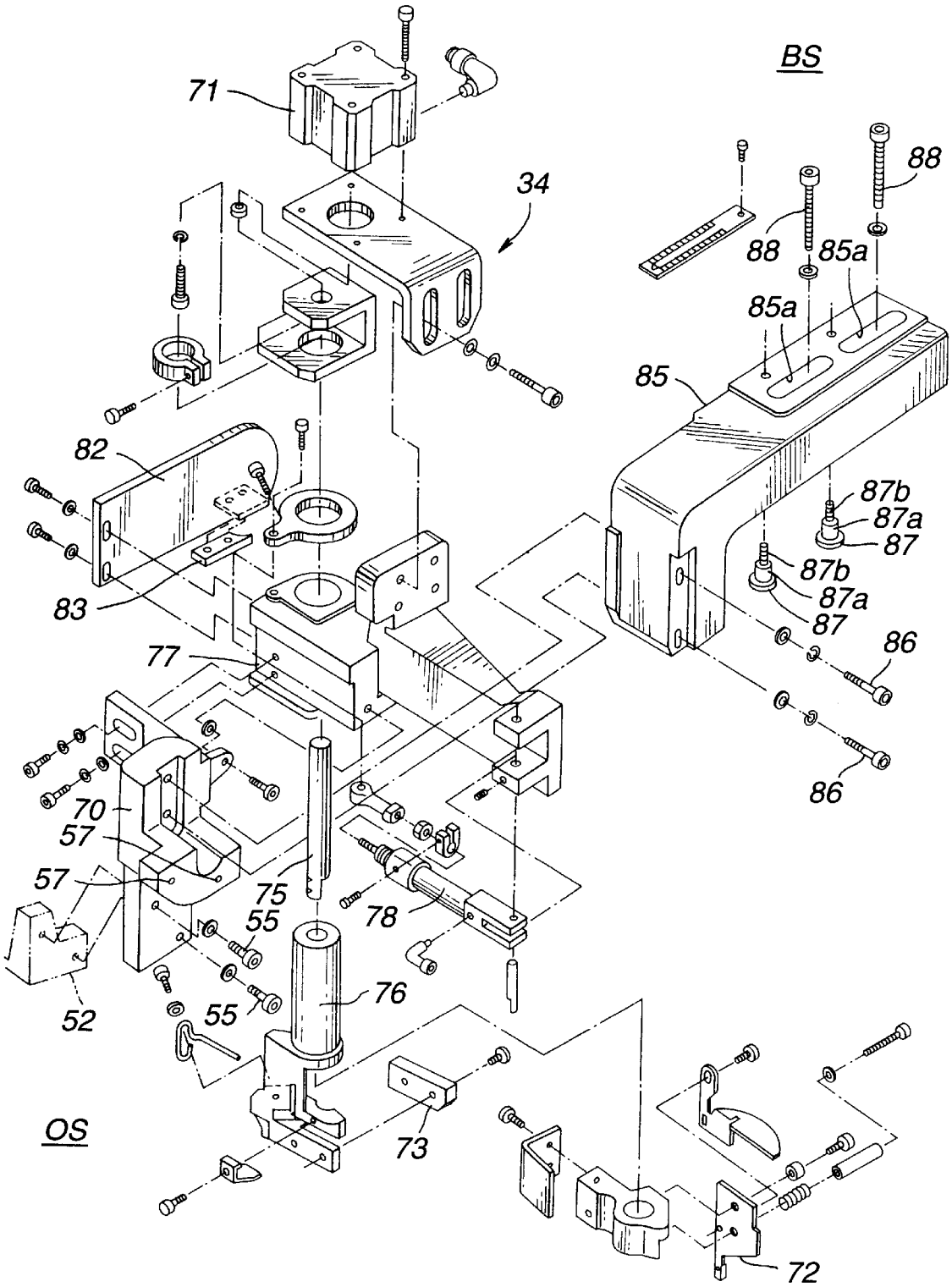
FIG. 5 shows an exploded perspective view showing an essential portion of a tape cutting means of the embodiment of the belt-loop sewing machine according to the present invention.

The tape delivering means 37 according to this embodiment, as shown in FIGS. 4 to 6, is formed into a unit integrally joined to a joining bracket 70. The joining bracket 70 and the unit guide 85 are provided for the joining base 91 secured to the base 90. That is, a tape delivering base 51 is supported below the delivering roller 40 by a deliver-frame receiver 52 such that a tape delivering surface 50 of the tape delivering base 51 is made to substantially be horizontal. The tape delivering base 51 has an upper surface provided with the flat tape delivering surface 50 on which the tape 12 can be placed. A loose roll 53 which can be rotated to follow the rotations of the delivering roller 40 is rotatively disposed at the leading end of the deliver-frame receiver 52 disposed downstream in the direction (indicated with an arrow B shown in FIG. 4) in which the tape 12 is delivered. That is, at least a portion of the tape delivering surface 50 which is located below the delivering roller 40 is cut away, which forms an opening (not shown) in the vertical direction. The upper outer surface of the loose roll 53, which is exposed in the opening, is substantially flush with the tape delivering surface 50.

The base portion of a swing arm 54 rotative around a support shaft 54*a* thereof is joined to the side surface of the deliver-base receiver 52. The leading end of the swing arm 54 is rotatively joined to the rotative shaft 42. Moreover, downward spring force is exerted. Thus, the delivering roller 40 presses the upper outer surface of the loose roll 53.

As shown in FIG. 5, the deliver-frame receiver 52 is joined to a surface of the joining bracket 70 by fixing screws 55. The joining bracket 70 is, with fixing screws 86, joined to the side surface of the leading end of a unit guide 85 formed into a lateral L-shape. As shown in FIG. 4, the tape delivering motor 44 is joined to the delivering-motor bracket 47. The delivering-motor bracket 47 is joined to a surface of the joining bracket 70 by screwing fixing screws 56 into screw holes 57 (see FIG. 5) through joining holes 56*a*.

The rear portion of the unit guide 85 on the back side BS is joined to a unit joining portion 92 (see FIG. 6) of the joining base 91 in such a manner that the position of the rear portion can be adjusted in the direction in which the tape 12 is moved. Specifically, guide portions 87*a* of stepped screws 87 are inserted into a guide groove 92*a* provided for the unit joining portion 92. Then, thread portions 87*b* are screwed to the unit guide 85. When the guide portions 87*a* are moved in the guide groove 92*a*, the unit guide 85 can be moved on the unit joining portion 92 in the direction in which the tape 12 is moved. Moreover, fixing screws 88 are inserted into elongated holes 85*a* formed in the unit guide 85 so as to be screwed to the upper surface of the unit joining portion 92. Thus, the unit guide 85 is secured to the upper surface of the unit joining portion 92.

This embodiment has the structure that the tape delivering means 37 is supported by the joining base 91 in a cantilever manner. As a matter of course, the present invention is not limited to the foregoing structure. If a space can be formed around the sewing position P8, a structure may be employed in which, for example, the tape delivering means 37 is supported from a position above a drawing frame 112 in a cantilever manner.

As shown in FIG. 4, thickness detecting means 60, which is capable of continuously detecting the thickness of the tape 12, is provided for the deliver-frame receiver 52 of the tape delivering means 37 according to this embodiment. The thickness detecting means 60 incorporates a thickness detecting plate 61 having the base portion which is joined to the outer surface of a delivering-plate shaft 62. The leading end of the thickness detecting plate 61 can vertically be moved owing to the action of a spring 63 to always press the tape delivering surface 50. The delivering-plate shaft 62 is supported by the deliver-frame receiver 52 such that substantially horizontal rotations of the delivery-plate shaft 62 are permitted in a direction perpendicular to the direction in which the tape 12 is moved.

Note that interference of the delivering-plate shaft 62 with the tape delivering base 51 is avoided. An operation gear 64 having on its outer surface a tooth portion 64*a* is joined to an end of the delivering-plate shaft 62. A sensor gear 65 is meshed with to the tooth portion 64*a* of the operation gear 64. A thickness sensor 67 is secured to the joining bracket 66 joined to the deliver-frame receiver 52. The sensor gear 65 is secured to a detecting shaft 67*a* of the thickness sensor 67. When the detecting shaft 67*a* is rotated owing to the rotations of the sensor gear 65, a variation of the rotational angle of the sensor gear 65 is detected by the thickness sensor 67. The thickness sensor 67 is electrically connected to the control means 48 (see FIG. 18) to be described later. Thus, the variation of the rotational angle detected by the thickness sensor 67 is output to the control means 48. The foregoing thickness detecting means 60 causes the leading end of the thickness detecting plate 61 to linearly be moved in the vertical direction according to a fact whether or not the tape 12 exists and change in the thickness of the tape 12. The vertical movement of the leading end of the thickness detecting plate 61 causes the operation gear 64 to be rotated around the delivering-plate shaft 62. Thus, the sensor gear 65 engaged to the tooth portion 64*a* of the operation gear 64 is rotated. The variation of the rotational angle of the sensor 65 is, as an analog value, output from the thickness sensor 67 to the control means 48.

The thickness sensor 67 is, for example, a rotary-type magnetic potentiometer.

As shown in FIGS. 1 to 3 and 17, the tape cutting means 34 is disposed adjacent to the delivering roller 40 at a downstream position in the direction in which the tape 12 is moved. After the tape 12 has been delivered for a predetermined length toward the belt-loop forming position P4, the tape cutting means 34 vertically moves to cut the tape 12 so as to form a tape (the belt loop) having a predetermined length.

The tape cutting means 34 comprises a movable blade 72 disposed above the movement passage for the tape 12 vertically movable; a fixed blade 73 disposed opposite the movable blade 72 below the movement passage for the tape 12; and a cutting drive means 71 having a reciprocative air cylinder connected to vertically move the movable blade 72.

As shown in FIG. 5, the joining bracket 70 for supporting the tape cutting means 34 is secured to the deliver-base receiver 52 of the tape delivering means 37. A knife bracket 77 is secured to the side surface of the upper portion of the joining bracket 70. A fixed-blade joining member 76 is supported by the knife bracket 77.

The movable blade 72 is secured to the lower end of a drive rod 75 having an upper end rotatively connected to an output shaft (not shown) of the cutting drive means 71. The upper portion of the fixed-blade joining member 76 is rotatively engaged to the outer surface of the drive rod 75. Both of the movable blade 72 and the fixed blade 73 according to this embodiment are made to be rotative by a knife rotating drive means 78 having a reciprocative air cylinder. Thus, the end of the belt loop 27 obtained by cutting the tape 12 can be formed into a triangle shape.

The cutting-means drive means 71 can be controlled by a cutting electromagnetic valve 79 (see FIG. 18) connected to the control means 48 (see FIG. 18) to be described later. The knife rotating drive means 78 can be operated by a knife rotating electromagnetic vale 80 (see FIG. 18) connected to the control means 48 (see FIG. 18) to be described later. In accordance with control commands issued from the control means 48 to the operation electromagnetic valve 79 and the knife rotating electromagnetic valve 80, the knife rotating drive means 78 are operated at predetermined timing.

The tape cutting means 34 is integrally joined to the joining bracket 70. Moreover, the tape cutting means 34 is secured to a position always apart from set position P1 (see FIG. 1) for a predetermined distance which is the position of contact between the delivering roller 40 and the loose roll 53 of the tape delivering means 37.

A sensor joining plate 82 horizontally projecting toward the downstream position in the tape moving direction is joined to the joining bracket 70 at a position above the movement passage for the tape 12. A forward-position detecting sensor 83 having a proximity switch for detecting the forward movement of a paired gripping arms 101 is joined to the lower surface of the leading end of the sensor joining plate 82. The forward-position detecting sensor 83 is electrically connected to the control means 48 (see FIG. 18) to be described later. When a forward position detector 84 provided for the paired gripping arms 101 to be described later has been moved closer, the forward-position detecting sensor 83 detects the forward position (see FIG. 1). Then, the forward-position detecting sensor 83 outputs a detection signal to the control means 48.

Therefore, the tape cutting means 34 formed into a unit according to this embodiment is, together with the tape delivering means 37, integrally joined to the joining bracket 70 so as to be formed into a unit. Moreover, the tape cutting means 34 is supported in cantilever manner at a position above the joining base 91 through the joining bracket 70 and the unit guide 85, the position being a position of the operator side OS and above the table surface 30*a*. The tape delivering means 37 is disposed upstream in the direction in which the tape 12 is fed.

Figure 7:
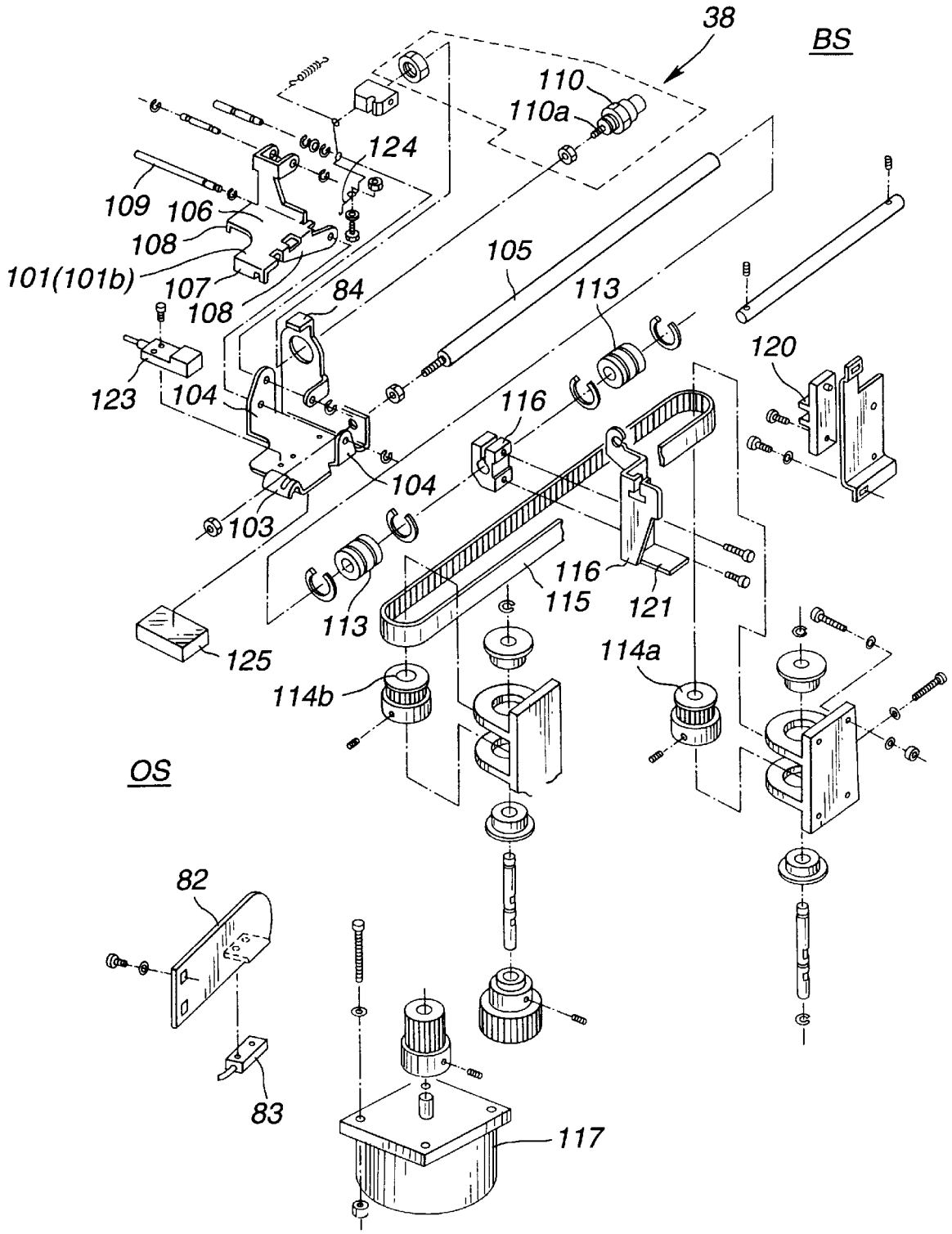
FIG. 7 shows an exploded perspective view showing an essential portion of a tape drawing means of the embodiment of the belt-loop sewing machine according to the present invention.

As shown in FIG. 7, the fixed arm 101*a* of the tape drawing means 38 has a plate-like base 102 formed into a L-shape. A gripping portion 103 is formed at the leading end of the base 102 on the operator side OS. The gripping portion 103 is substantially flush with the lower surface of the tape 12 or slightly lower the same to permit placing of the tape 12 delivered by the tape delivering means 73. A paired side plates 104 stand erect oppositing to each other at the side edges of the base 102. The leading end of a drive rod 105 for substantially horizontally moving the paired gripping arms 101 in a forward/rearward direction toward the leading end of the tape 12 is joined to a lower position of the side wall of the base 102. Moreover, a tape discharging means 125 is secured to the lower surface of the base 102 of the fixed arm 101*a*. The tape discharging means 125 is made of, for example, an elastic material, for example, sponge. When the paired gripping arms 101 move forward, an unnecessary portion of the tapes 12 supported by a tape receiving surface 135 of a tape support unit 130 to be described later, for example, a portion of the tapes 12 each having a stepped portion, such as a seam, can automatically be removed from the tape receiving surface 135 (by the tape discharging means 125). That is, the unnecessary portion of the tapes 12 can easily and reliably be discharged.

An L-shaped and flat base portion 106 is provided for the movable arm 101*b*. A gripping portion 107 extending toward the gripping portion 103 is provided for the leading end of the base portion 106 at the operator side OS. Link portions 108 facing downwards are formed on the two side surfaces of the base portion 106. The link portions 108 are rotatively supported by an arm support shaft 109 supported by the side plates 104. An output shaft 110*a* of an opening/closing drive means 110 having a reciprocative air cylinder supported by the fixed arm 101*a* is connected to the upper portion of the base portion 106. When the opening/closing drive means 110 is operated, the base portion 106 is swung around the arm support shaft 109 so that the gripping portion 107 is brought into contact with and moved away from the gripping portion 103. The opening/closing drive means 110 can be operated by an opening/closing electromagnetic valve 111 (see FIG. 18) connected to the control means 48 (see FIG. 18). In accordance with a control command output from the control means 48 to the opening/closing electromagnetic valve 111, the opening/closing drive means 110 swings the base 106 up and down at predetermined timing for a predetermined stroke.

The drive rod 105 is supported in parallel with the tape feed direction in the axial direction by two bearings 113 joined to a drawing frame 112 (see FIGS. 3 and 6) joined to the base 90. Paired timing belts pulleys 114*a* and 114*b* disposed apart from each other and located adjacent to the bearing 113 are provided for the drawing frame 112. A rod driving timing belt 115 disposed in parallel with the drive rod 105 are arranged between timing belt pulleys 114*a* and 114*b*. A drive rod 105 is, by paired and proper securing members 116, secured to a portion of the rod driving timing belt 115. The timing belt pulley 114*b* disposed on the operator side OS can be rotated by a tape drawing motor 117 disposed in a lower portion and comprising a stepping motor and so forth. When the tape drawing motor 117 is rotated, the drive rod 105 is allowed to reciprocate. As a result, the paired gripping arms 101 is moved forwards/rearwards with respect to the leading end of the tape 12. The tape drawing motor 117 is electrically connected to the control means 48 (see FIG. 18). In accordance with a control command given from the control means 48, the tape drawing motor 117 is rotated at predetermined timing.

Figure 3:
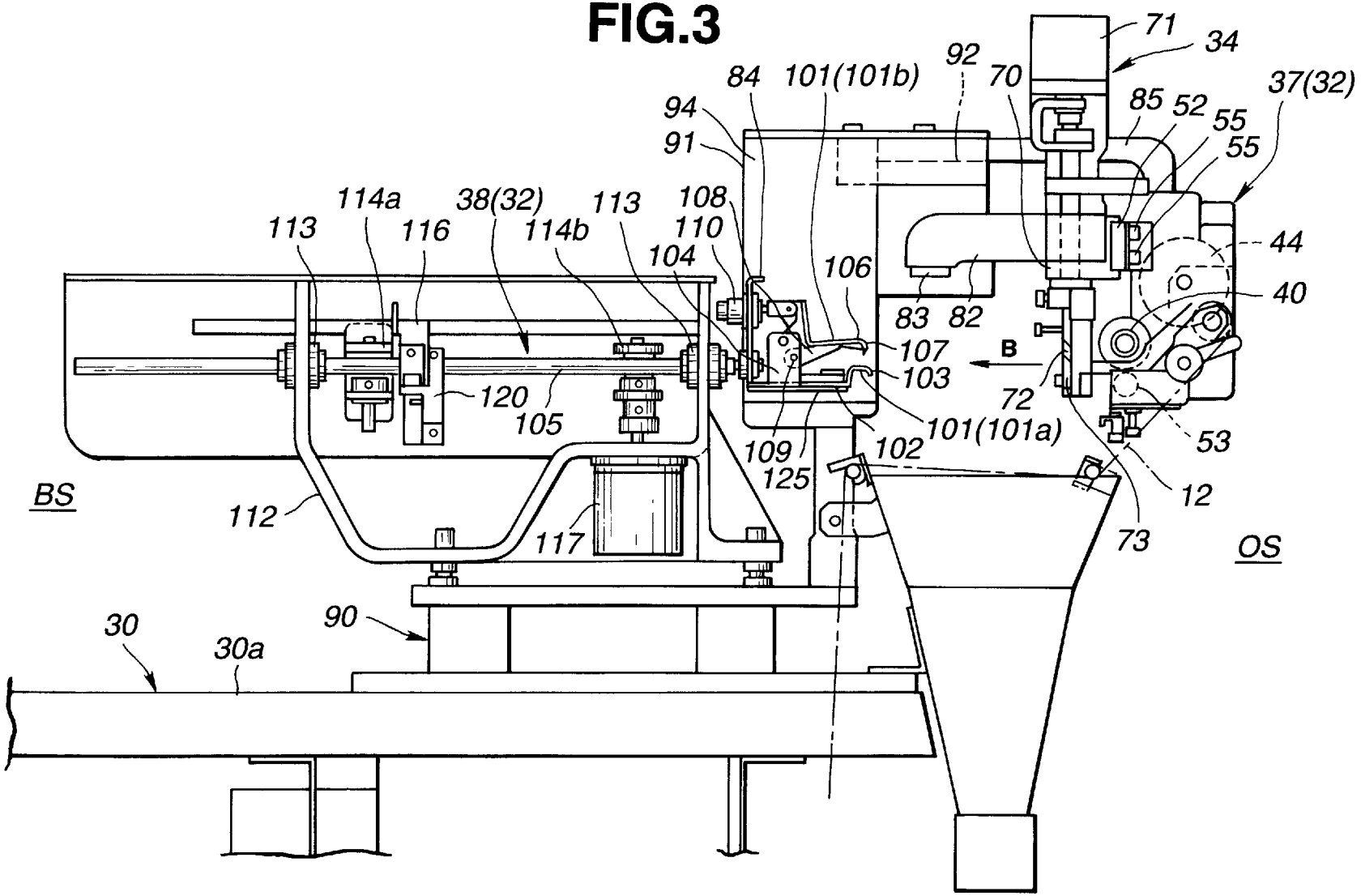
FIG. 3 shows a left side view showing essential portions of a tape supply means and a tape cutting means of the embodiment of the belt-loop sewing machine according to the present invention when the foregoing means are viewed from a left-handed position.

The drawing frame 112 is provided with a rearward-position detecting sensor 120 comprising a proximity switch for detecting the rearward position of the paired gripping arms 101 of the tape drawing means 38 (see FIG. 3). The rearward position detecting sensor 120 is electrically connected to the control means 48 (see FIG. 18) to be described later. When a rearward-position detector 121 (see FIG. 7)

joined to the rod driving timing belt 115 has approached, the rearward-position detecting sensor 120 detects the rearward position of the paired gripping arms 101 of the tape drawing means 38 to output a detection signal to the control means 48.

A tape detecting means 123 (see FIG. 7) for detecting whether or not the tape 12 exists when the paired gripping arms 101 hold the leading end of the tape 12, is disposed on the upper surface of the base 102 of the fixed arm 101*a*. The tape detecting means 123 is operated in accordance with contact/separation of a detecting member 124 made to be elastically deformed by a coil spring disposed opposite to the lower surface of the movable arm 101*b* for the purpose of enabling the tape detecting means 123.

That is, the tape drawing means 38 is formed into a unit. When the paired gripping arms 101 have held the leading end of the tape 12, the tape 12 is able to prevent approach of the detecting member 124 to the tape detecting means 123. When the paired gripping arms 101 do not hold the leading end of the tape 12, the detecting member 124 can approach the tape detecting means 123. With this structure, whether or not the tape 12 exists is detected.

Although this embodiment has the structure that the tape delivering means 37 and the tape drawing means 38 constitute the tape supply means 32, the tape supply means 32 may comprise only the tape delivering means 37.

The detailed structure of the tape support means 33 will now be described with reference to FIGS. 1, 3, 6 and 8 to 11.

The tape support means 33, from a lower position, supports positions adjacent to the two lengthwise-directional ends of the tape 12 supplied to the belt-loop forming position P4 by the tape supply means 32. As shown in FIG. 1, the tape support means 33 incorporates a paired tape support units 130 disposed between the tape delivering means 37 and the tape drawing means 38. One of tape support units 130 disposed on the operator side OS shown in the lower portion of FIG. 1 is a front tape support unit 130*a* for, from a lower position, supporting a portion adjacent to the base portion of the tape 12 or the belt loop 27 obtained by cutting the tape 12. The other tape support units 130 disposed in the back side BS in the upper portion of FIG. 1 is a rear tape support unit 130*b* for, from a lower position, supporting a portion adjacent to the leading end of the tape 12 or the belt loop 27 obtained by cutting the tape 12.

Figure 8:
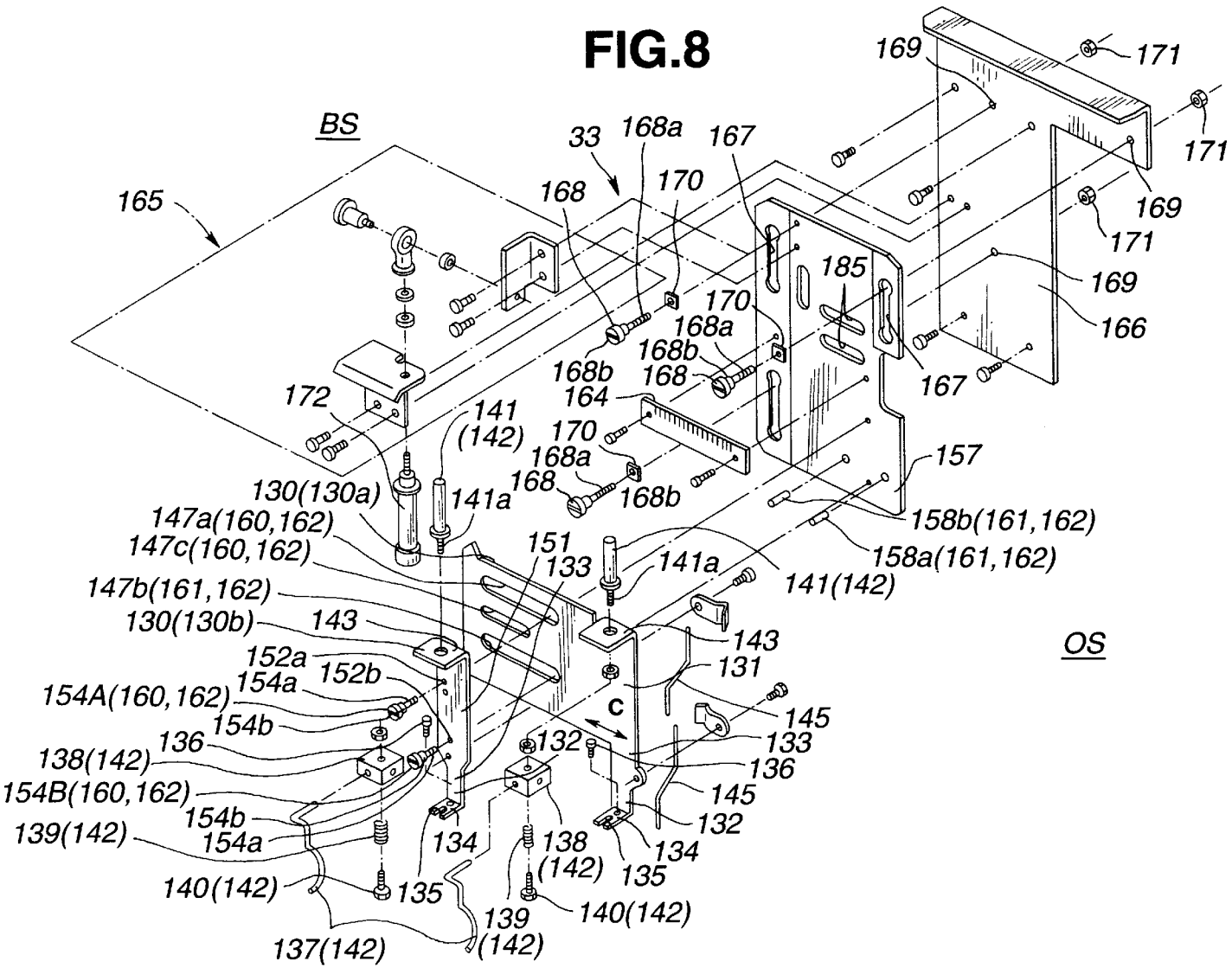
FIG. 8 shows an exploded perspective view showing an essential portion of a tape support means of the embodiment of the belt-loop sewing machine according to the present invention.

As shown in FIG. 8, the front tape support unit 130*a* incorporates a base 131 formed into a laterally elongated plate-like shape. A tape receiving portion 132 is formed in the lower portion of the base 131 on the operator side OS. The tape receiving portion 132 incorporates a vertical portion 133 downwards extending form the lower end of the base 131 and a horizontal portion 134 bent from the leading end of the vertical portion 133 towards the machine body 2 and having the leading end forked sections. The upper surface of the horizontal portion 134 is formed into a tape receiving surface 135 for, from a lower position, supporting a portion adjacent to the base portion of the tape 12 supplied to the belt-loop forming position P4. A positioning screw 136 for limiting the position of the tape 12 moved to the belt-loop forming position P4 is joined to the base portion of the tape receiving surface 135. The right-hand edge of the tape 12 moved to the belt-loop forming position P4 shown in the right-hand portion of FIG. 1 is brought into contact with the outer surface of the positioning screw 136 so as to be positioned.

A guide rod 137 being substantially wedge-shape when viewed from front side, is disposed above the tape receiving surface 135, the guide rod 137 being structured to cause the tape 12 fed to the belt-loop forming position P4 to be pushed closer to the locating screw 136. The guide rod 137 has an upper end joined to the side surface of a guide-rod joining member 138, the position of which can be adjusted in a direction substantially perpendicular to the tape feed direction. According to the width of the tape 12, the position of the leading end of the guide rod 137 shown in the lower portion of FIG. 8 can easily be adjusted. An upper end of a compression coil spring 139 for holding the tape 12 pushed closer to the positioning screw 136 by the guide rod 137 against the upper surface of the tape receiving surface 135 with predetermined contact force is joined to the lower surface of the guide-rod joining member 138. A contact member 140 which is brought into contact with the tape 12 and moved away from the same is joined to the lower end of the compression coil spring 139. A leading end of an output shaft 141*a* of a tape pushing and holding means 141 comprising a reciprocative air cylinder is connected to the upper surface of the guide-rod joining member 138. The tape pushing and holding means 141 is joined to a cylinder joining portion 143 extending form the upper portion of the base 131 in the operator side OS and opposite to the tape receiving surface 135. The tape pushing and hold means 141 can be operated by a tape pushing and holding electromagnetic valve 144 connected to the control means 48 (see FIG. 18) to be described later. In accordance with a control command output from the control means 48 to the tape pushing and holding electromagnetic valve 144, the tape pushing and holding means 141 is driven at predetermined timing.

The guide rod 137, the guide-rod joining member 138, the compression coil spring 139, the contact member 140 and the tape pushing and holding means 141 constitute a tape pushing and holding means 142 for pushing the tape 12 or the belt loop 27 to a predetermined position and pressing and holding the same.

Figure 9:
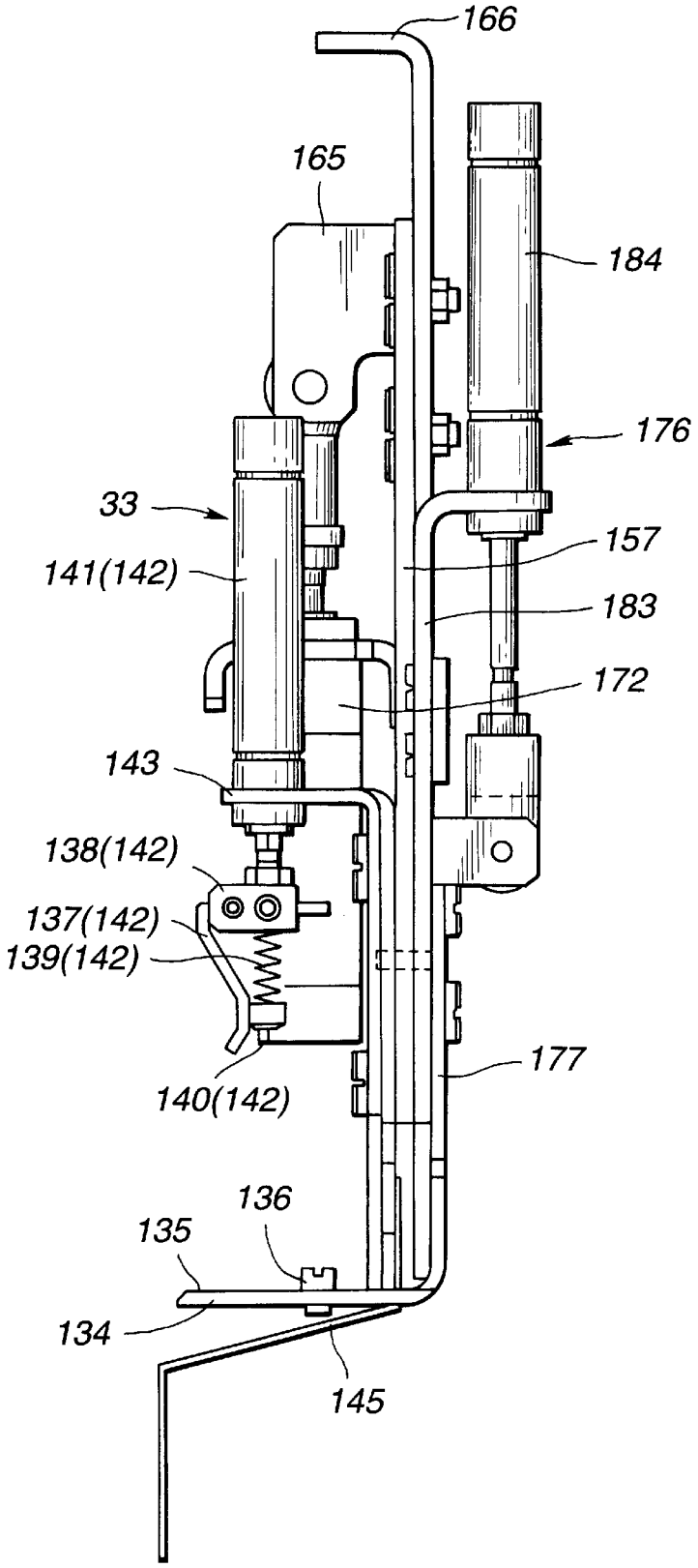
FIG. 9 shows an enlarged view showing an essential portion of a state in which a loop removing member of the tape support means of the embodiment of the belt-loop sewing machine according to the present invention is joined when the state is viewed from the operation side.

An upper portion of a loop discharge member 145 formed into a substantially stepped shape is joined to the reverse side (when viewed from the operator side OS) of the vertical portion 133 of the tape receiving portion 132. The lower portion of the loop discharge member 145 extends to a position below the leading end of the horizontal portion 134 of the tape receiving portion 132, as shown in FIG. 9.

Paired elongated groove openings 147*a* and 147*b* are formed (at the back side BS) and in the upper and lower portions of the base 131 of the front tape support unit 130*a*, the elongated groove openings 147*a* and 147*b* being formed apart from each other and extending in parallel with each other in the tape feed direction. An elongated groove opening 147*c* in different size extending in parallel in the tape feed direction is formed between the elongated groove openings 147*a* and 147*b*.

The rear tape support unit 130*b* comprises a base 151 formed into an elongated plate-like shape, a tape receiving portion 132 similar to the front tape support unit 130*a* and having a vertical portion 133 and a horizontal portion 134 having a tape receiving surface 135 on the supper surface thereof, a tape pushing and holding means 142 constituted by a guide rod 137, a guide-rod joining member 138, a compression coil spring 139, a contact member 140, a cylinder joining portion 143 and a tape pushing and holding drive means 141, and a loop discharge member 145. Paired through holes 152*a* and 152*b* penetrating the base 151 in a direction of the thickness of the base 151 are formed in the base 151 of the rear tape support unit 130*b*. The distance between the through holes 152*a* and 152*b* is the same as the distance between the two elongated groove openings 147*a* and 147*b* formed in the base 131 of the front tape support unit 130*a*. The base 131 of the front tape support unit 130*a* is superimposed on the reverse side (a right side when viewed from the operator side OS) of the base 151 of the rear tape support unit 130*b*. Then, the fixing screw 154A which is inserted into both of the hole 152*a* and the elongated groove opening 147*a* and the fixing screw 154B which is inserted into both of the through hole 152*b* and the elongated groove opening 147*b* are screwed into a movable base 157. Thus, both of the front tape support unit 130*a* and the rear tape support unit 130*b* are secured to the movable base 157.

When the tape support units 130 has been secured to the movable base 157, paired front and rear guide pins 158*a* and 158*b* projecting over the movable base 157 and disposed apart from each other are engaged in the elongated groove opening 147*c* formed in the base 131 of the front tape support unit 130*a*.

Each of the two fixing screws 154A and 154B, which are called stepped screw, according to this embodiment has a shape having a cylindrical guide portion 154*b* at the head portion of a thread portion 154*a*. The guide portion 154*b* is inserted into both of the through holes 152*a* and 152*b* and the elongated groove openings 147*a* and 147*b*. The guide pins 158*a* and 158*b* according to this embodiment are, for example, spring pins, each can be enlarged/reduced in size in the radial direction.

Figure 10:
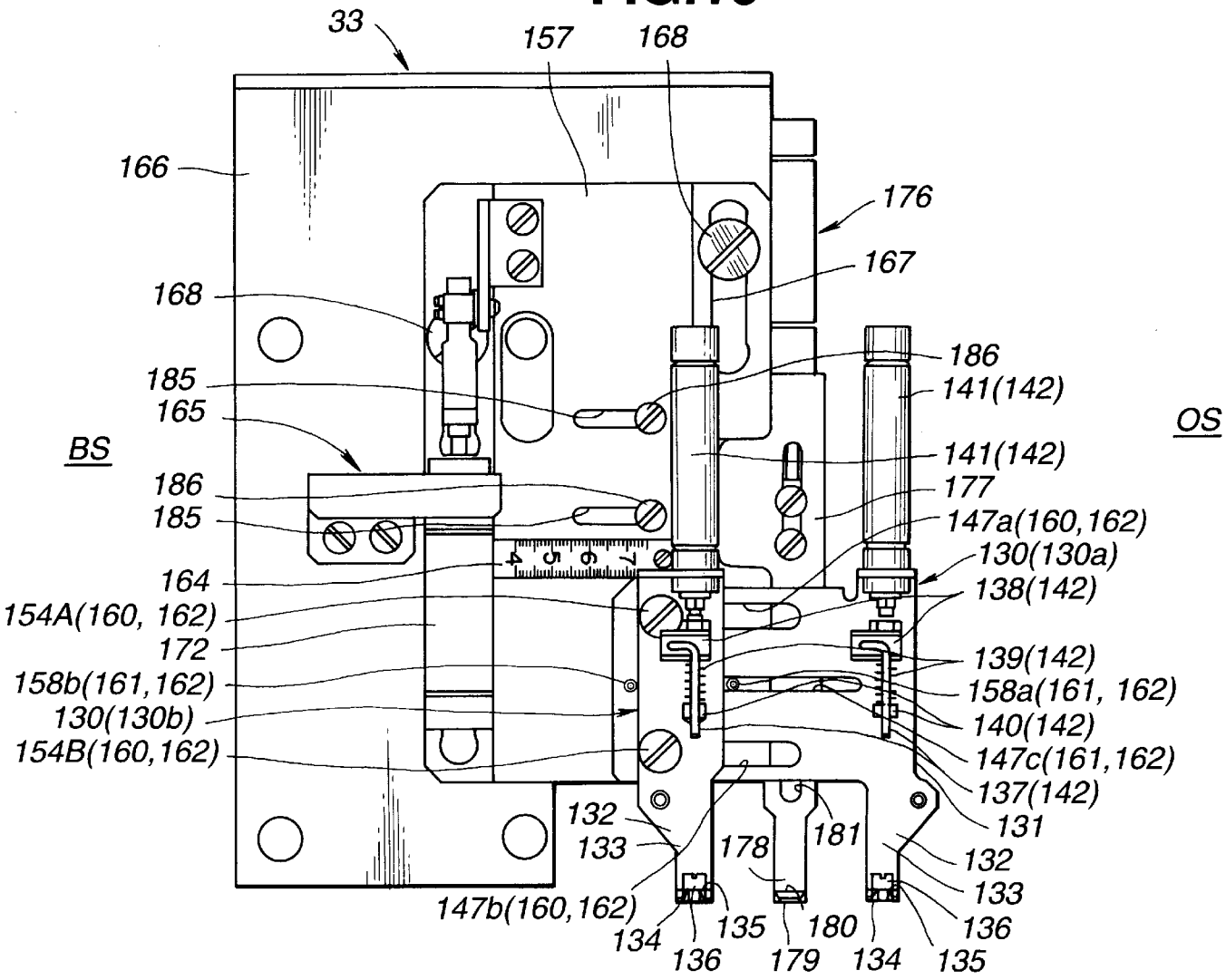
FIG. 10 shows an enlarged view showing an essential portion showing a state in which the distance between tape support units for the tape support means of the embodiment of the belt-loop sewing machine according to the present invention has been enlarged and also showing the fullness forming unit when the state is viewed from a position adjacent to the machine body.
Figure 11:
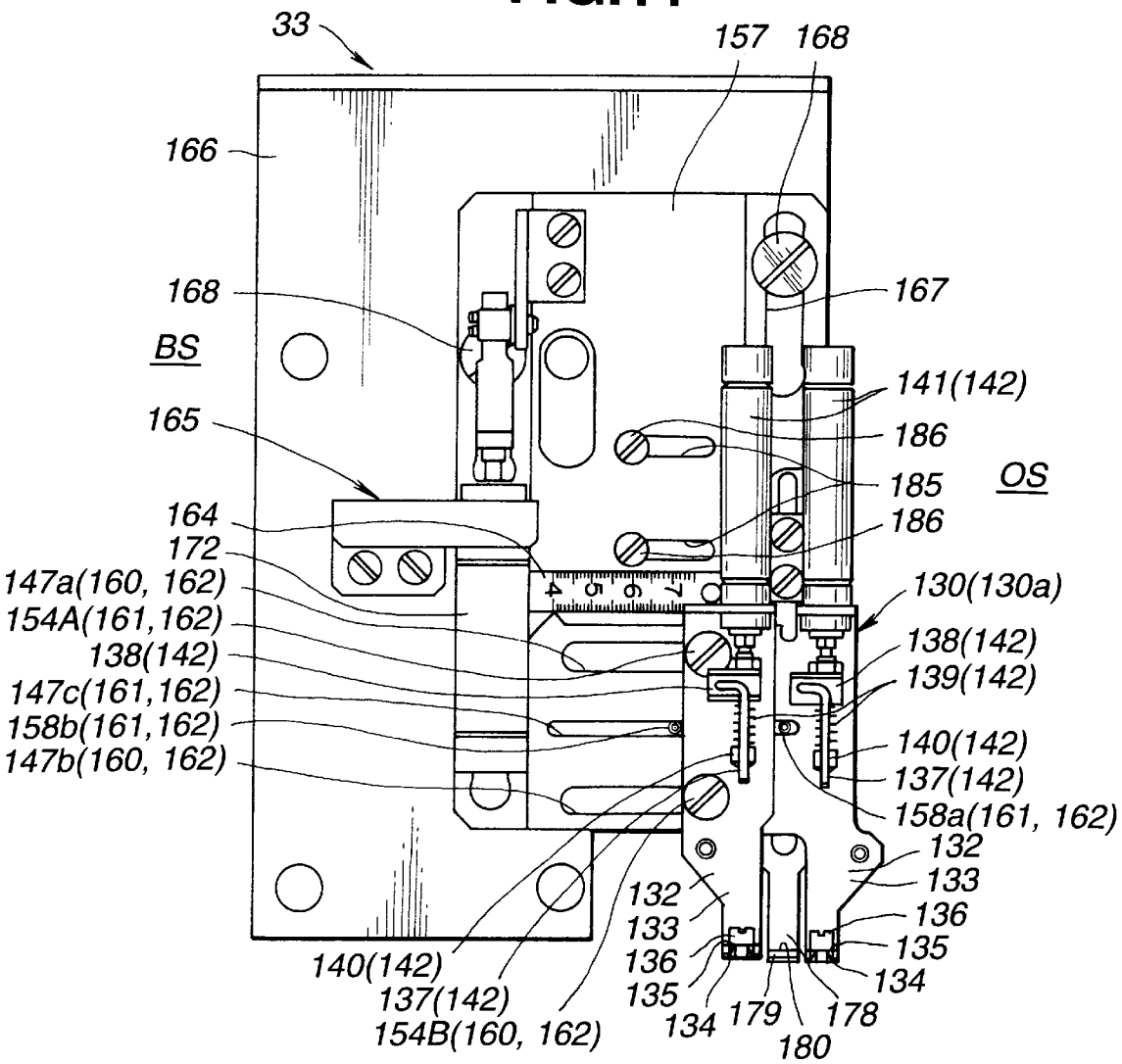
FIG. 11 shows an enlarged view showing an essential portion showing a state in which the distance between the tape support units to the tape support means of the embodiment of the belt-loop sewing machine according to the present invention has been reduced and also showing the fullness forming unit when the state is viewed from a position adjacent to the machine body.

When the two fixing screws 154A and 154B are loosened, the front tape support unit 130*a* is moved to be brought close to the rear tape support unit 130*b*, the position of which has been fixed, and moved apart from the same as indicated with an arrow C shown in FIG. 8. The front tape support unit 130*a* is moved in the tape feed direction. As a result, the distance can easily be adjusted such that the distance between the tape support units 130*a* and 103*b* is elongated as shown in FIG. 10 and the distance between the tape support units 130*a* and 130*b* is reduced as shown in FIG. 11.

That is, the rear tape support unit 103*b* of the tape support unit 130 is secured to the movable base 157. On the other hand, the front tape support unit 130*a*, which is the other tape support unit, is made to be movable such that the front tape support unit 130*a* is brought close to the rear tape support unit 130*b* and moved apart from the same.

The elongated groove openings 147*a* and 147*b* and the fixing screws 154A and 154B constitute a height limiting means 160 according to this embodiment. The elongated groove opening 147*c* and the guide pins 158*a* and 158*b* projecting over the movable base 157 constitute and attitude control means 161 according to this embodiment. The height limiting means 160 and the attitude control means 161 constitute a distance adjustment means 162 according to this embodiment.

A scale plate 164 for indicating the distance between the tape support units 130*a* and 130*b* is attached to the movable base 157 such that the lengthwise direction of the scale plate 164 runs along the tape feed direction.

The movable base 157 has one guide groove 167 formed at upper side of the operator side OS and two guide grooves 167 formed at upper and lower positions of the back side BS apart from each other in the vertical direction. Each of the three guide grooves 167 is formed into an elongated shape in the vertical direction perpendicular to the tape feed direction. A square block 170 which is capable of moving in the vertical direction is engaged to the guide groove 167. A guide portion 168*b* of the stepped screw 168 is inserted into the square block 170. A thread portion 168*a* of the stepped screw 168 is inserted into a guide hole 169 formed in a fixed plate 166 so as to allow the leading end of a thread portion 168*a* of a stepped screw 168 to project over the reverse side (right side in FIG. 8) of the fixed plate 166. A nut 171 is screwed to a thread portion 168*a* projecting over the reverse side of the fixed plate 166 so that the movable base 157 is joined to the fixed plate 166 such that vertical movement of the movable base 157 is permitted.

The movable base 157 can be moved vertically with respect to the fixed plate 166 by a movable base drive means 172, which is joined to the fixed plate 166 through a cylinder joining bracket 165 and comprising a reciprocative air cylinder. The movable base drive means 172 can be operated by a moveable base electromagnetic valve 173 (see FIG. 18) connected to the control means 48 (see FIG. 18). In accordance with a control command output from the control means 48 to the movable base electromagnetic valve 173, the movable base drive means 172 is operated at predetermined timing.

The fixed plate 166 is joined to a tape-support-means joining portion 94 of the joining base 91 shown in FIGS. 3 and 6.

A fullness forming unit 176 is joined to the reverse side of the movable base 157 according to this embodiment.

Figure 12:
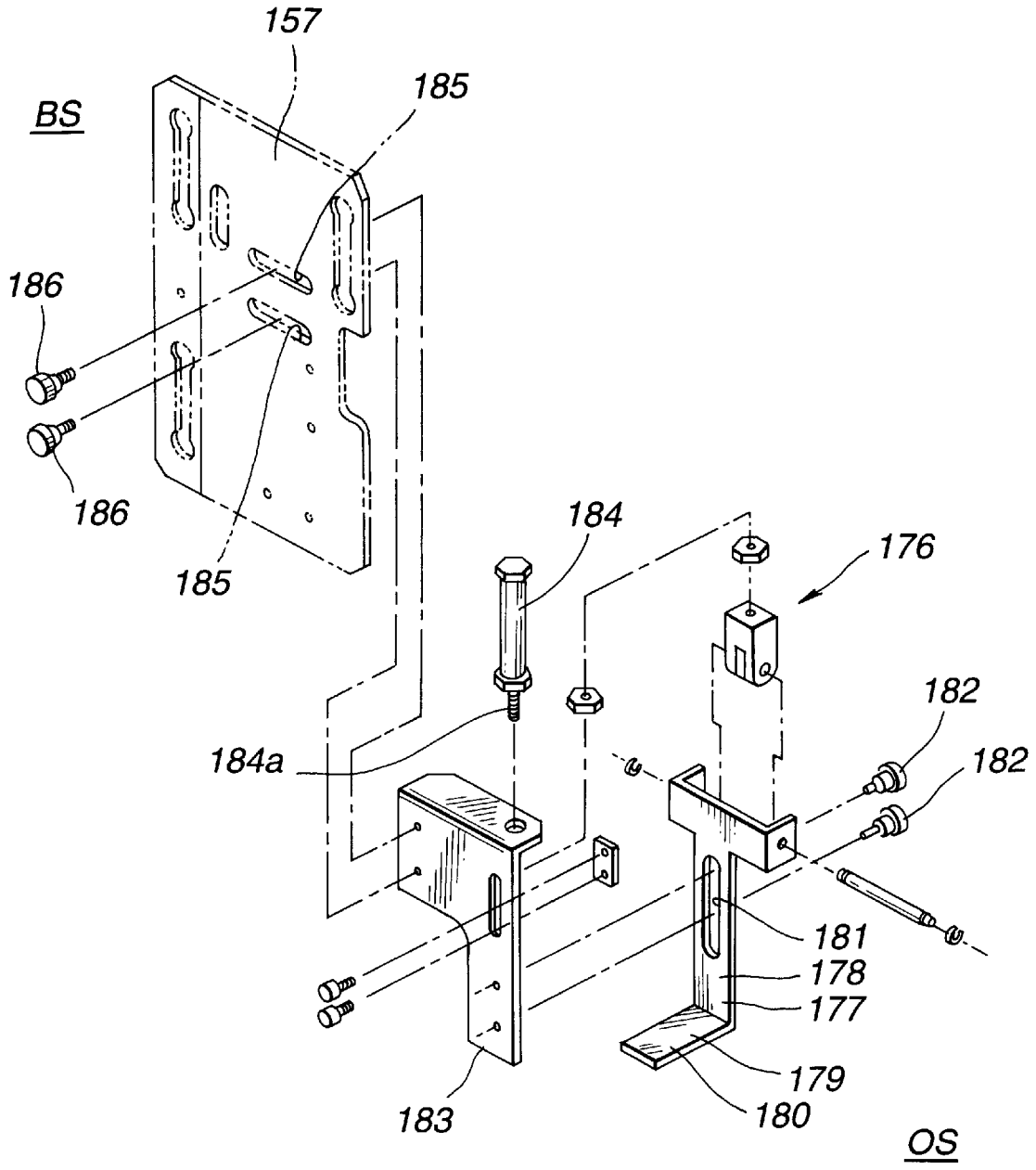
FIG. 12 shows an exploded perspective view showing an essential portion of the fullness forming unit of the embodiment of the belt-loop sewing machine according to the present invention.

The fullness forming unit 176 will now be described with reference to FIG. 12.

The fullness forming unit 176 forms a shape having a loosened central portion by raising the substantially central portion of the belt loop 27 into a substantially ridge shape. The fullness forming unit 176 has a fullness-forming-tape receiver 177. The fullness-forming-tape receiver 177 is disposed between the tape receiving surfaces 132 of the tape support units 130*a* and 130*b* to, from a lower position, support the tape 12 or the belt loop 27 at the belt-loop forming position P4. The fullness-forming-tape receiver 177 has an elongated plate-like base 178. A horizontal plate portion 179, which is bent into a direction of the thickness of the base 178 toward the machine body 2 at the left side when viewed from the operator side OS, is provided for the lower end of the bas 178. The upper surface of the horizontal plate portion 179 is formed into a substantially flat fullness-forming-tape receiving surface 180 for, from the lower position, supporting the substantially central portion of the tape 12 moved to the belt-loop forming position P4.

An elongated guide groove-shape hole 181 is formed in the base 178 of the fullness-forming-tape receiver 177. Two fixing screws 182 arranged to be inserted into the guide groove-shaped 181 hole are screwed into a unit joining bracket 183. Thus, the fullness-forming-tape receiver 177 is joined to the unit joining bracket 183 such that the vertical movement of the fullness-forming-tape receiver 177 is permitted. A fullness forming drive means 184, which is capable of individually and vertically moving the fullness-forming-tape receiver 177 and which comprises a reciprocative air cylinder, is joined to the upper portion of the unit joining bracket 183 such that an output shaft 184*a* of the fullness forming means 184 directs downwards. The output shaft 184*a* of the fullness forming means 184 is connected to the upper portion of the fullness-forming-tape receiver 177.

Paired elongated groove guide holes 185 each of which is elongated horizontally, are formed in substantially the central portion of the movable base 157. Two fullness-unit fixing screws 186, called "stepped screws", arranged to be inserted into the elongated groove guide holes 185 are inserted into the unit joining bracket 183. Thus, the movable base 157 and the fullness forming unit 176 are secured to each other. When the fullness-unit fixing screws 186 are loosened, the fullness forming unit 176 can be moved substantially in parallel with the lengthwise direction of the tape 12.

The operation of the movable base drive means 172 for vertically moving the movable base 157 causes the fullness forming unit 176 and the tape support units 130 to be moved vertically.

The loop supply means 35 will now be described with reference to FIGS. 1 and 13 to 15.

The loop supply means 35 folds back the two end portions of the belt loop 27, formed at the belt-loop forming position P4, toward the center of the belt loop 27, and supplies the folded belt loop 27 to the sewing position P8. As shown in FIG. 1, the loop supply means 35 has a front bending shaft 200*a* for bending the proximal end of the belt loop 27 and a rear bending shaft 200*b* for bending the leading end of the belt loop 27 (collectively called "bending shafts 200").

Figure 13:
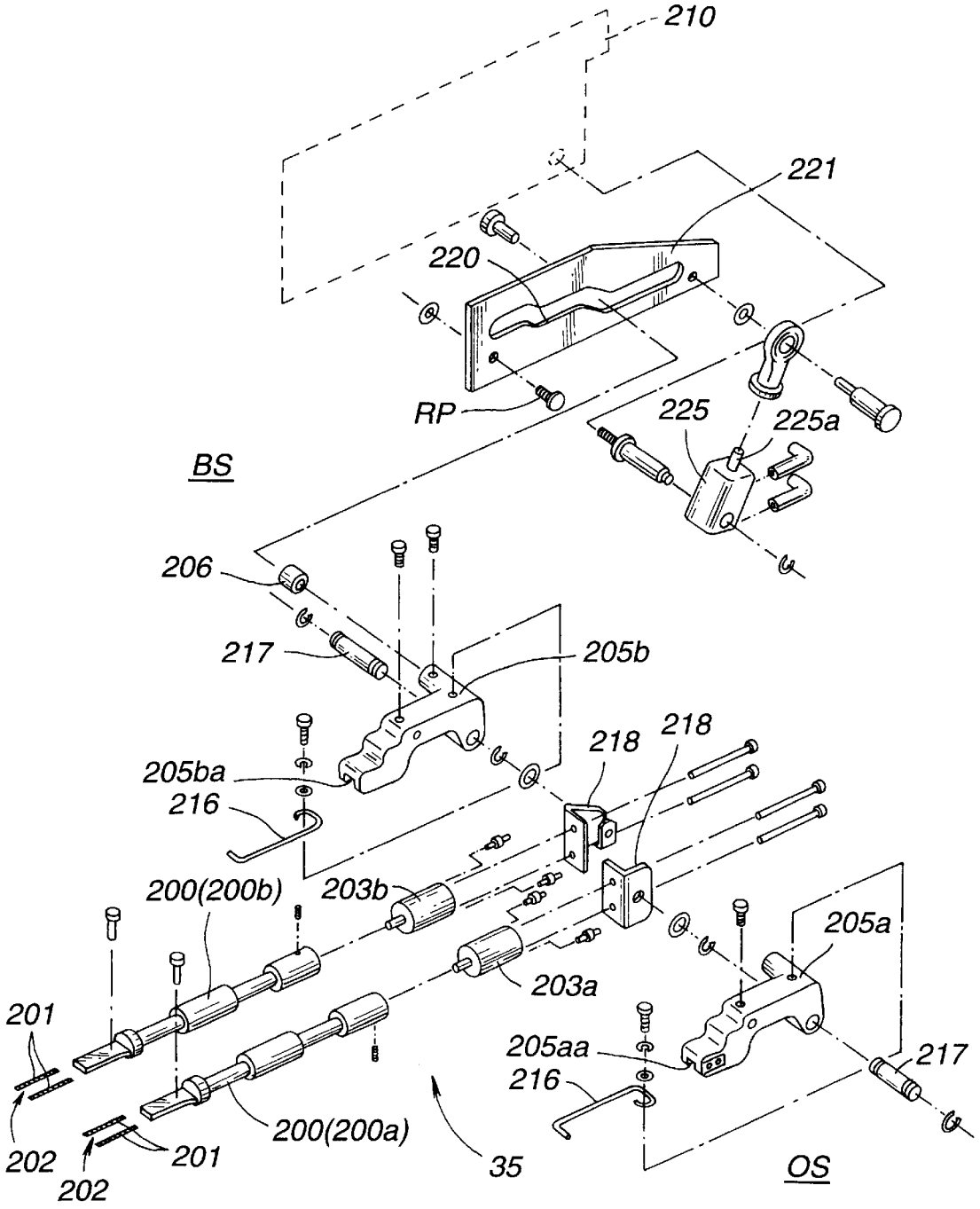
FIG. 13 shows an exploded perspective view showing a portion adjacent to the bending shaft of a loop supply means of the embodiment of the belt-loop sewing machine according to the present invention.

Referring to FIG. 13, parallel pins 201 located apart from each other for a predetermined distance are secured to the leading ends of the bending shafts 200*a* and 200*b* to form a fork 202 which is capable of inserting the tape 12 (the belt loop 27). Bending drive means 203*a* and 203*b*, which are capable of rotating the respective bending shafts 200*a* and 200*b* and which comprise rotary air cylinders, are connected to the base portions of the bending shafts 200*a* and 200*b*. The bending means 203*a* and 203*b* have respective bending electromagnetic valves 204*a* and 204*b* (see FIG. 18). In accordance with a control command output from the control mans 48 (see FIG. 18), the bending electromagnetic valves 204*a* and 204*b* are able to independently rotate the shafts at the same or different timings. The timings at which the bending shafts 200*a* and 200*b* are operated may be determined to be adaptable to the operation sequence for forming the fullness of the belt loop 27 or to the design concept.

The proximal ends of the bending means 203*a* and 203*b* are secured to respective brackets 218. The brackets 218 are supported by support shafts 217 rotatively with respect to bending-shaft support members 205*a* and 205*b* which are seesaw levers.

The central portions of the bending shafts 200*a* and 200*b* are inserted into support grooves 205*aa* and 205*ba* formed in the leading ends of the bending-shaft support members 205*a* and 205*b*, the support grooves 205*aa* and 205*ba* being opened downwards. Moreover, urging springs 216 are secured at each proximal end to the bending-shaft support members 205*a* and 205*b*, and their distal ends are engaged to each of the bending shafts 200*a* and 200*b*. The bending shafts 200*a* and 200*b* are urged upwards by the urging springs 216 so as to be pressed against the support grooves 205*aa* and 205*ba* of the bending-shaft support members 205*a* and 205*b*. When the fork 202 formed at the leading ends of the bending shafts 200*a* and 200*b* is added with a downward load, the bending shafts 200*a* and 200*b* rotate around the rotational axes of the brackets 218 against the urging force. As a result, the fork 202 can be moved downwards for a predetermined distance.

A joining frame 210 is secured to the base 90 (see FIG. 6) such that the joining frame 210 stands erect. A cam plate 221 is supported by a rotation pivot shaft RP, and rotatable with respect to the joining frame 210.

An output shaft 225*a* of a cam drive means 225 comprising a reciprocative cylinder having the lower end supported by the joining frame 210 for rotating the cam plate 221 around the rotation support shaft RP, is connected to an end of the cam plate 221 opposite to the rotation pivot shaft RP. The cam plate 221 has a horizontally elongated cam groove 220 having a length corresponding to the distance between the retracting position P5 and the sewing position P8. The cam groove 220 has three stepped portions so that the portion of the cam groove 220 corresponding to the sewing position P8 is higher than that corresponding to the retracting position P5.

Figure 14:
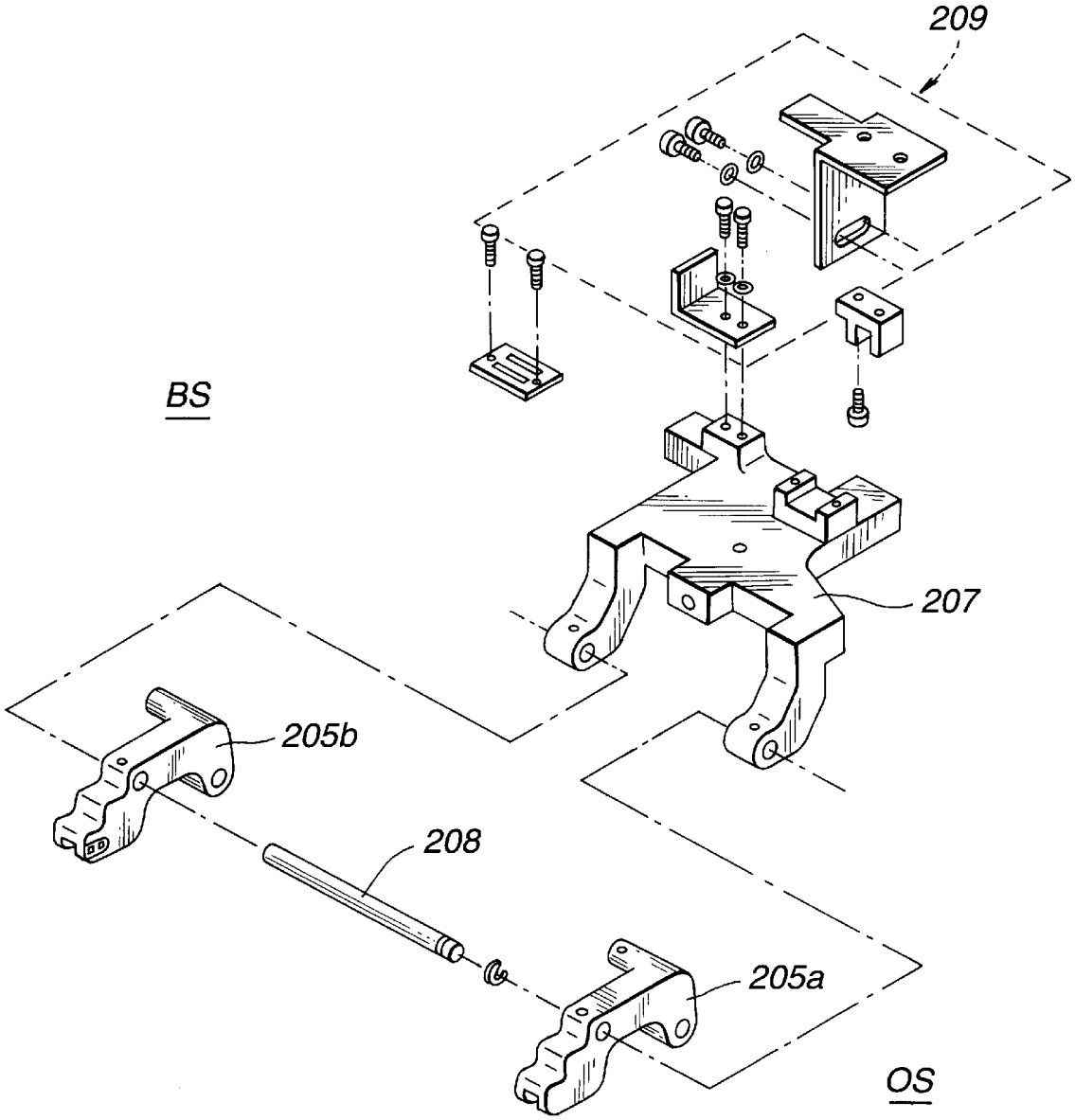
FIG. 14 shows an exploded perspective view showing a portion adjacent to a moving base of the loop supply means of the embodiment of the belt-loop sewing machine according to the present invention.

Referring to FIG. 14, bending-shaft support members 205*a* and 205*b* of the bending shaft 200 are supported by a connection shaft 208 provided for the movable base 207. The bending-shaft support members 205*a* and 205*b* are so formed as to be moved in the axial direction of the connection shaft 208 so that the distance between the bending-shaft support members 205*a* and 205*b* is adjustable corresponding to the length of the belt loop 27.

The movable base 207 is secured to a fixed member 209 disposed above the movable base 207. The fixed member 209 is secured to the lower surface of a timing belt 213 (see FIG. 5) so as to be moved as the timing belt 213 is moved.

Figure 15:
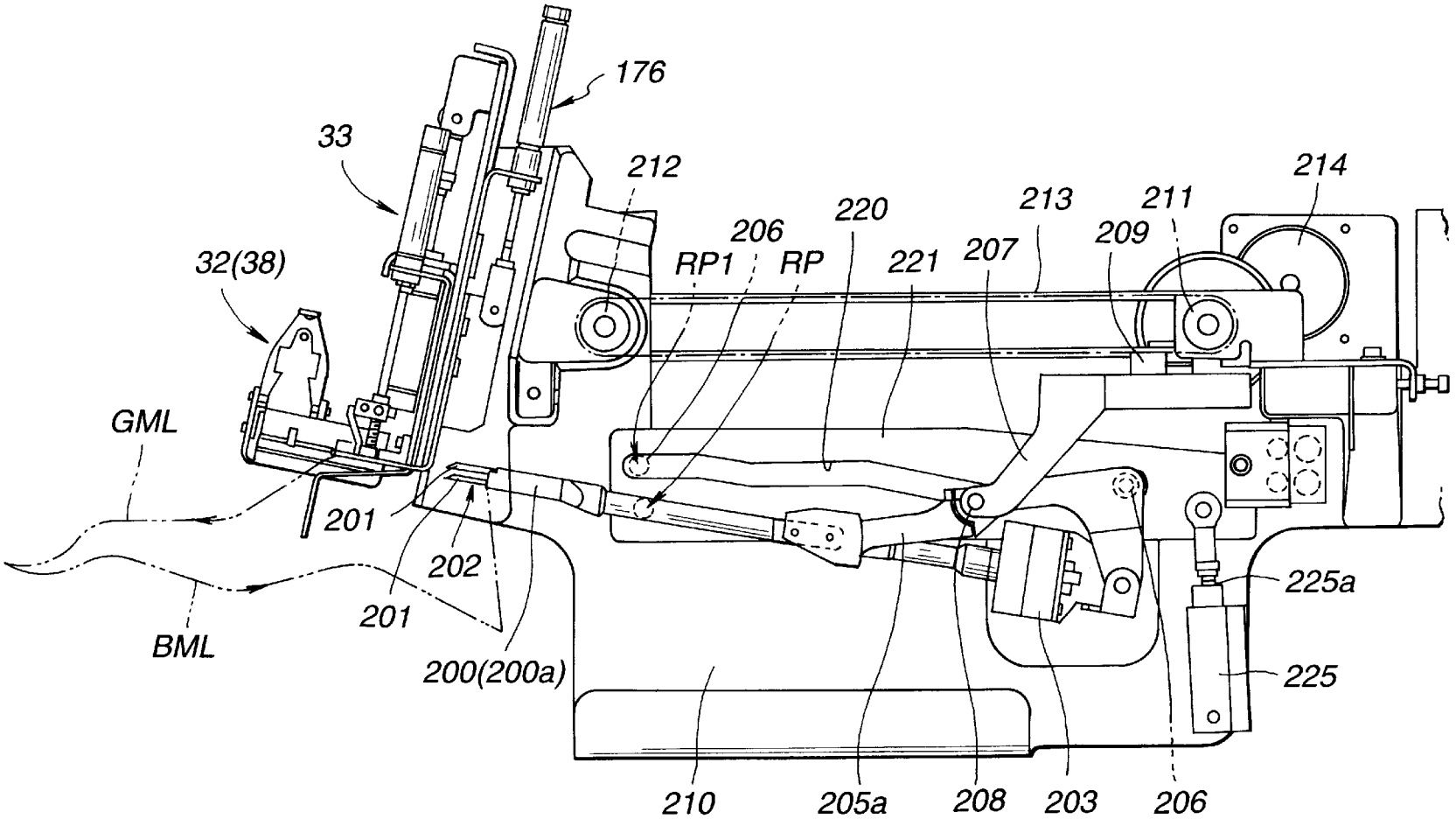
FIG. 15 shows a front view showing an essential portion of the loop supply means of the embodiment of the belt-loop sewing machine according to the present invention when the means is viewed from a position adjacent to the operation side.

Referring to FIG. 15, the timing belt 213 is arranged between timing belt drive pulley 211 and a follower timing belt pulley 212 rotatively disposed at positions apart from each other for a predetermine distance. The timing belt drive pulley 211 is driven by a moving drive means 214 comprising a stepping motor. The moving drive means 214 is electrically connected to the control means 48 (see FIG. 18) to be described later. In accordance with a control command output from the control means 48, the moving drive means 214 is activated at predetermined timing. The cam follower 206 is disposed so as to be close to the rotation pivot RP of the cam plate 221 when the bending shaft 200 has been positioned to the sewing position P8.

As the timing belt 213 has been moved, the bending shafts 200*a* and 200*b* are, together with the bending-shaft support members 205*a* and 205*b* supported by the movable base 207, caused to reciprocate between the retracting position P5 and the sewing position P8. At this time, the cam groove 220 to which the cam follower 206 is engaged limits the vertical positions of the upper shafts 217 of the bending-shaft support members 205*a* and 205*b*. As a result, also the vertical positions of the forks 202 at the leading ends of the bending-shaft support members 205*a* and 205*b* are limited.

Figure 18:
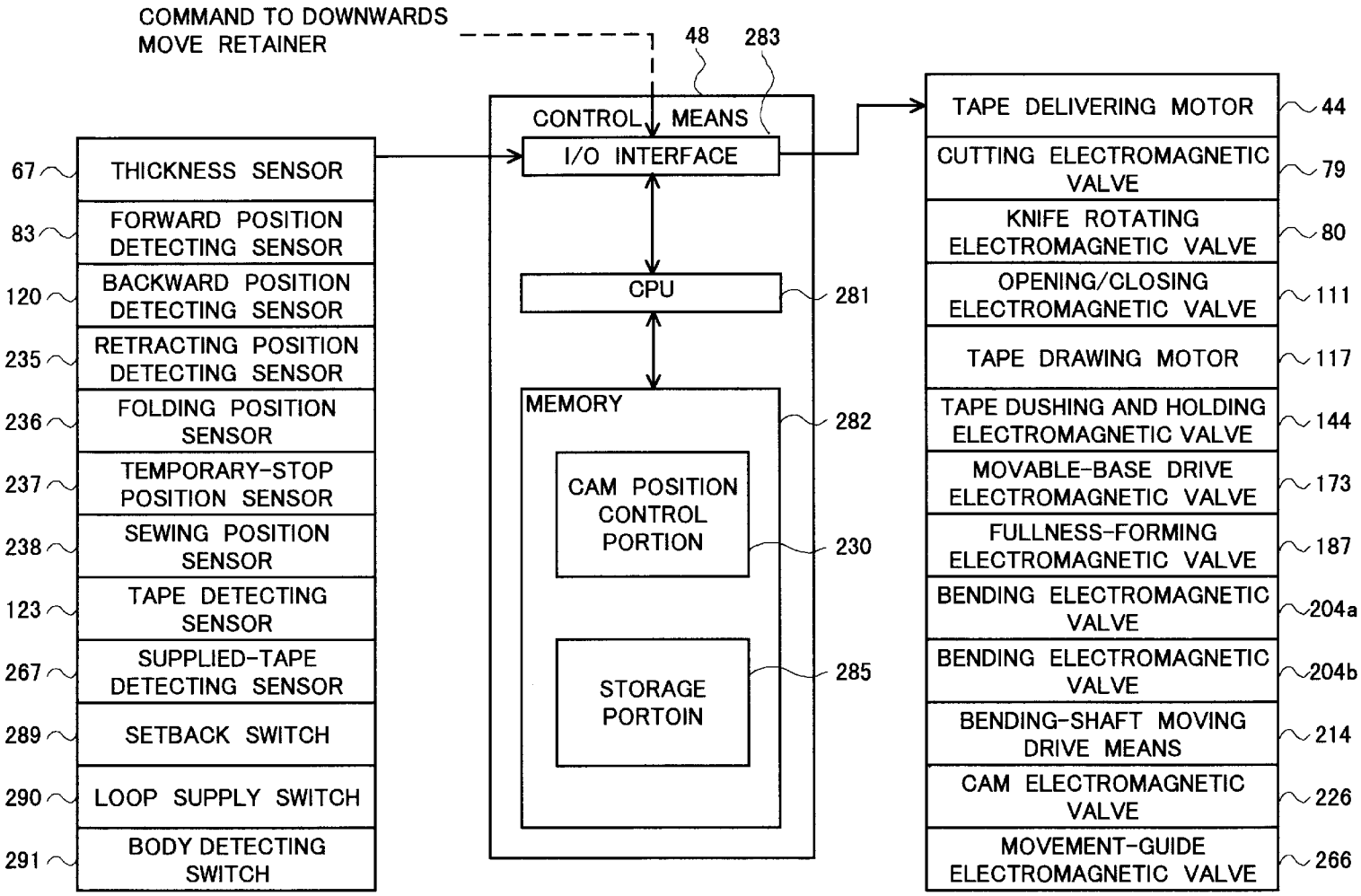
FIG. 18 shows a block diagram showing a control means of a belt-loop supply unit of the embodiment of the belt-loop sewing machine according to the present invention.

The cam drive means 225 is activated by a cam electromagnetic valve 226 (see FIG. 18) connected to the control a means 48 (see FIG. 18). In accordance with a control command output on the basis of a program stored in a cam-positioned control portion 230 (see FIG. 18), the cam drive means 225 pushes out the output shaft 225*a* when the bending shaft 200 has been positioned to the sewing position P8. When the paired bending shafts 200 have been returned to arbitrary positions beyond the loop folding position P6, the retracting position P5 in this embodiment, the cam drive means 225 pulls the output shaft 225*a*. As a result, a movement locus (an imaginary line shown in FIG. 15) of the fork 202 of the bending shaft 200 is controlled such that the forward movement locus GML from the retracting position P5 to the sewing position P8 and the rearward movement locus BML from the sewing position P8 to the retracting position P5 are different from each other. Specifically, the rearward movement locus BML according to this embodiment arranged such that the fork 202 of the bending shaft 200 is allowed to pass through below the movement locus of the gripping arm 101. As a result, the gripping arm 101\can be moved in the forward direction during the reverse movement of the bending shaft 200.

It is most preferable that the cam follower 206 is structured such that the cam follower 206 position coincides with the rotation pivot RP of the cam plate 221, that is, the cam follower 206 and the rotation pivot RP coincide with each other as indicated with the imaginary line shown in FIG. 15 after the bending shaft 200 has been moved to the sewing position P8. The reason for this lies in that the position of the fork 202 is not changed when the cam plate 221 is rotated at the time when the cam follower 206 is located at the rotation pivot RP1.

The cam follower 206, the cam plate 221, the cam drive means 225 and the cam-position control portion 230 constitute a bending-shaft-movement-locus control means 231 according to this embodiment.

The joining frame 210 has, on the upper position thereof, a retracting-position sensor 235 (see FIG. 18) a folding-position sensor 236 (see FIG. 18), a temporary stop position sensor 237 (see FIG. 18) and a sewing-position sensor 238 (see FIG. 18) each of which comprises a proximity sensor, respectively, detecting the retracting position P5 of the bending shaft 200, the loop folding position P6, the temporary stop position P7 and the sewing position P8. The sensors 235, 236, 237 and 238 are electrically connected to the control means 48 (see FIG. 18) to be described later. when a detector (not shown) provided for the movable base 207 has been approached, the position of the movable base 207, that is, the position of the bending shaft 200 is detected. Then, a detection signal is output to the control means 48.

The loop supply means 35 according to this embodiment has the structure that the movable base 207 for supporting the bending shaft 200 is moved by the moving drive means comprising the stepping motor to move forwards and backwards the bending shaft 200. Note that the moving drive means may be another known means, such as a three-stage air cylinder or the like.

The operation for supplying the tape 12 will now be described in detail with reference to FIGS. 16 and 17.

The elongated tape 12 is wound around a tape reel 521 or accommodated in a accommodating box 252 indicated with an imaginary line. Therefore, rotation shaft 254 disposed in the axial portion of the tape reel 251 is supported by the two side walls of the sewing table 30 by means of shaft support members 255 opened upwards.

A tape forcibly drawing means is disposed on the operator side OS at the insider upper portion of the sewing table 30 according to this embodiment. The tape forcibly drawing means previously loads the tape 12 delivered from the tape reel 251 or the accommodating box 252 for a length required to form the belt loop 27 when the tape 12 is delivered to the belt-loop forming position P4 by the delivering roller 40 of the tape delivering means 37. Thus, the forcibly drawing means reduces and makes constant a load which is added to the tape delivering motor 44 when the tape 12 is supplied by the delivering roller 40. Moreover, the tape forcibly drawing means 260 prevents inverse movement of the tape 12.

The tape forcibly drawing means 260 comprises an input guide 261 for limiting the input-side movement passage for the tape 12; an output guide 262 for limiting the output-side movement passage for the tape 12; and a movement guide 263 disposed between the foregoing guides 261 and 262. Each of the input guide 261 and the output guide 262 is provided with an inverse-movement preventing claw 264 for preventing inverse movement of the tape 12 by pressing the tape 12 against the input guide 261 and the output guide 262. The movement guide 263 is connected to an output shaft 265*a* of a movement guide drive means 265 provided on the sewing table 30 substantially in parallel with the table surface 30*a* of the sewing table 30, the output shaft 265*a* being allowed to project toward the operator side OS. The movement guide 263 is moved forwards/rearwards between two positions which are the rearward position indicated with a solid line in FIG. 17 and a forward position indicated with an imaginary line in FIG. 17. The movement guide drive means 265 can be driven by a movement-guide electromagnetic valve 266 (see FIG. 18) connected to the control means to be described later. In accordance with a control command output from the control means 48 to the movement-guide electromagnetic valve 266, the movement guide drive means 265 is activated at predetermined timing. A supplied-tape detecting sensor 267 for detecting the existence of the tape 12, which must be supplied to the tape delivering means 37 of the belt-loop supply unit 31, is disposed below the inverse-movement preventing claw 264. Thus, an operator is able to recognize whether or not the tape 12 exists.

When the operator performs an operation in the operator side OS, the tape 12 is supplied through a passage such that the tape 12 is delivered from the tape reel 251 of the accommodating box 252. Then the tape 12 is guided to the tape forcibly drawing means disposed at the inside upper portion of the sewing table 30 (through the operator side OS of the sewing table 30). Then, the tape 12 is moved to the guide roller 271 rotatively disposed on the back side BS of the upper portion of the discharge chute 370 (mounted on the operator side OS of the table surface 30*a* of the sewing table 30) at its intermediate position in the height direction. Then, the tape 12 is guided to the guide roller 272 rotatively disposed on the operator side OS (of the upper portion of the discharge chute 270. That is, the tape is guided from the back side BS to the operator side OS of the upper portion of the discharge chute 270. Thereafter the tape is guided to the delivering means 37 of the belt-loop supply unit 31 from the operator side OS to the back side BS so that the leading end of the tape inserted into the setting position P1 which is the contact position between the delivering roller 40 and the loose roll 53.

An example of the control means 48 will now be described with reference to FIG. 18.

As shown in FIG. 18, the control means 48 according to this embodiment at least comprises a CPU 281, a memory 282 including a suitable capacity of ROM and RAM and so forth, and an I/O interface 283 for the connection with each element of the belt-loop sewing machine 25.

The following elements are connected to the I/O interface 283: the tape delivering motor 44, the cutting electromagnetic valve 79, the knife rotating electromagnetic valve 80, the opening/closing electromagnetic valve 111, the tape drawing motor 117, the tape pushing and holding electromagnetic valve 144, the movable base drive electromagnetic valve 173, the fullness forming electromagnetic valve 187, the bending electromagnetic valves 204*a* and 204*b*, the moving drive means 214, the cam electromagnetic valve 226, the movement-guide electromagnetic valve 266, the thickness sensor 67, the forward-position detecting sensor 83, the rearward-position detecting sensor 120, the retracting-position P5 detecting sensor 235, the folding-position sensor 236, the temporary-stop-position P7-sensor 237, the sewing-position P8 sensor 238, the tape detecting sensor 123, the supplied-tape detecting sensor 267, a setback switch 289, a loop supply switch 290, a body detecting sensor 291, an operation panel (not shown), a variety of switches and sensors (for controlling the sewing operation and sensors) such as a switch for starting the sewing operation of the machine body 2 and the like, and a machine motor and the like.

The operation panel is provided with a variety of setting switches (not shown) for setting, for example, the length of the belt loop and whether or not the fullness is provided, a power switch, a start switch and a display portion which is capable of displaying an error and a state of the operation.

The memory 282 at least includes the cam-position control portion 230 and a storage portion 285.

The cam-position control portion 230 stores the program for controlling the operation of the cam electromagnetic valve 226. The stored program is a program controlling the cam drive means 225 so as to retract the output shaft when the bending shaft 200 is positioned to the sewing position P8 and extending the output shaft when the bending shaft 200 is positioned to the retracting position P5.

The storage portion 285 has programs for controlling the operations and operation sequences of the elements of the belt-loop sewing machine 25, a program for forming a fullness of the belt loop 27, a program for initializing operation after power has been supplied, and a variety of data and programs required for the sewing operation.

The structure of the machine body 2 of the belt-loop sewing machine 25 is similar to that of a conventional structure. Therefore, the description of this structure is omitted.

Figure 19:
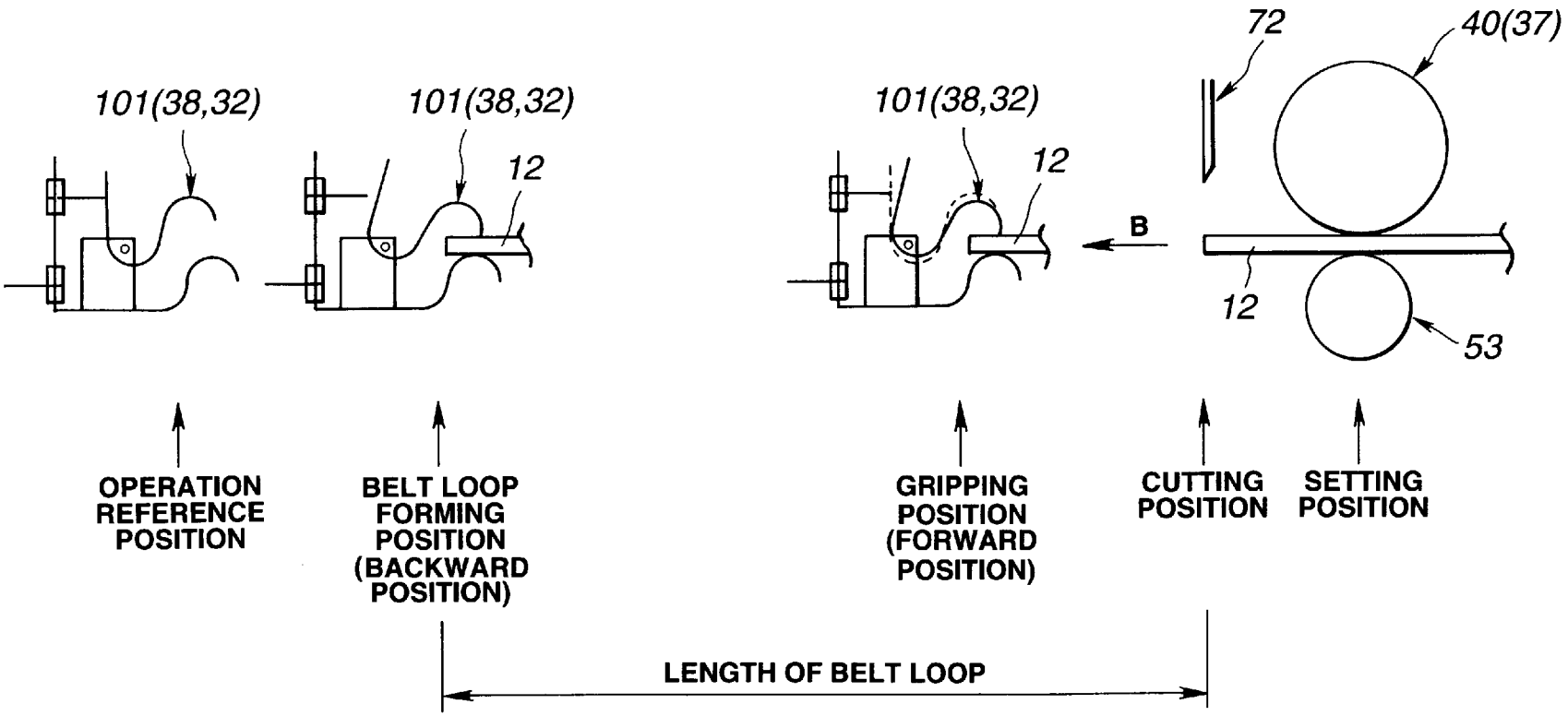
FIG. 19 shows a schematic view showing a state of supply of a tape by the tape supply means of the embodiment of the belt-loop sewing machine according to the present invention.
Figure 20:
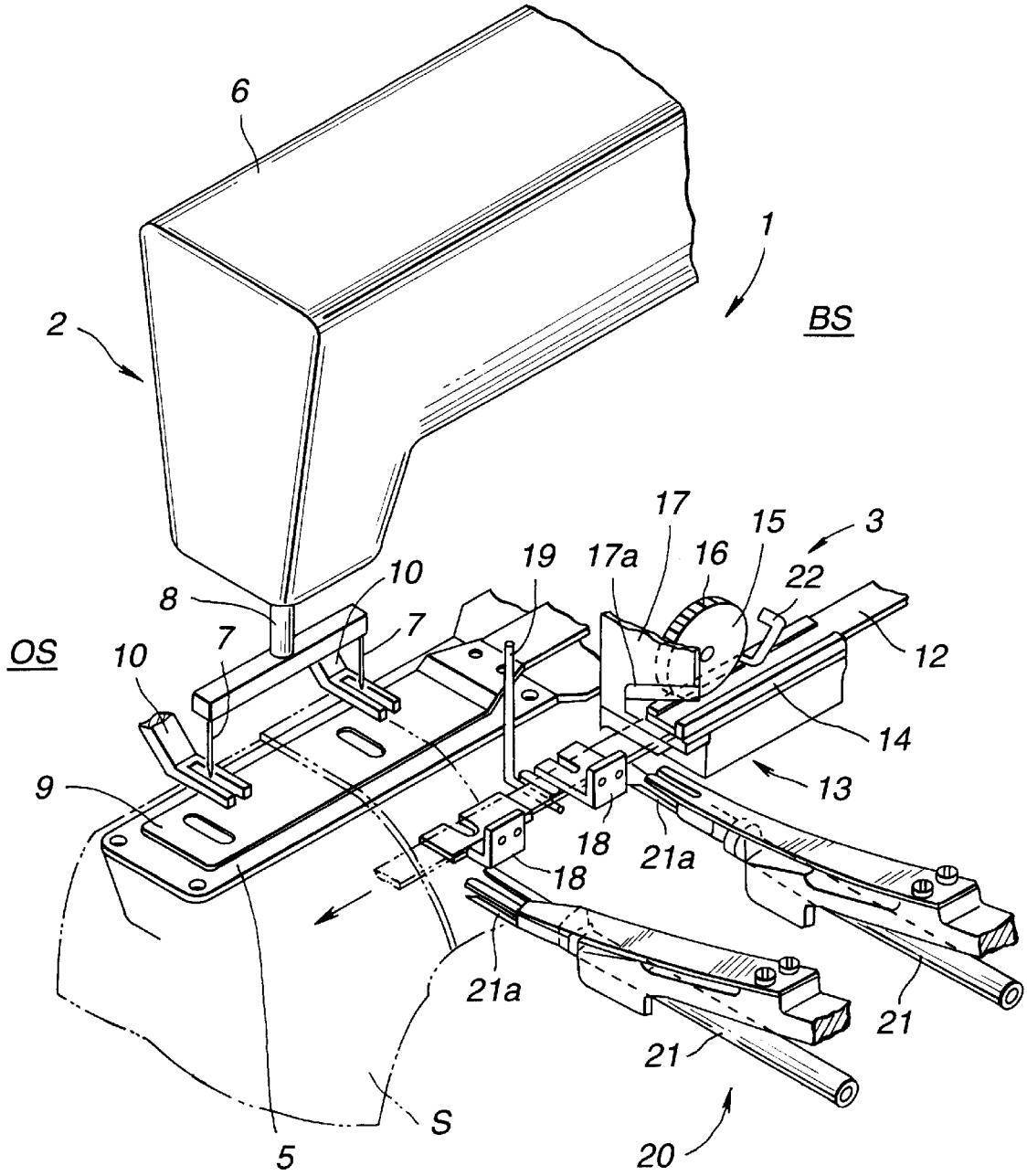
FIG. 20 shows a perspective view showing an essential portion of an example of a conventional belt-loop sewing machine.
Figure 21:
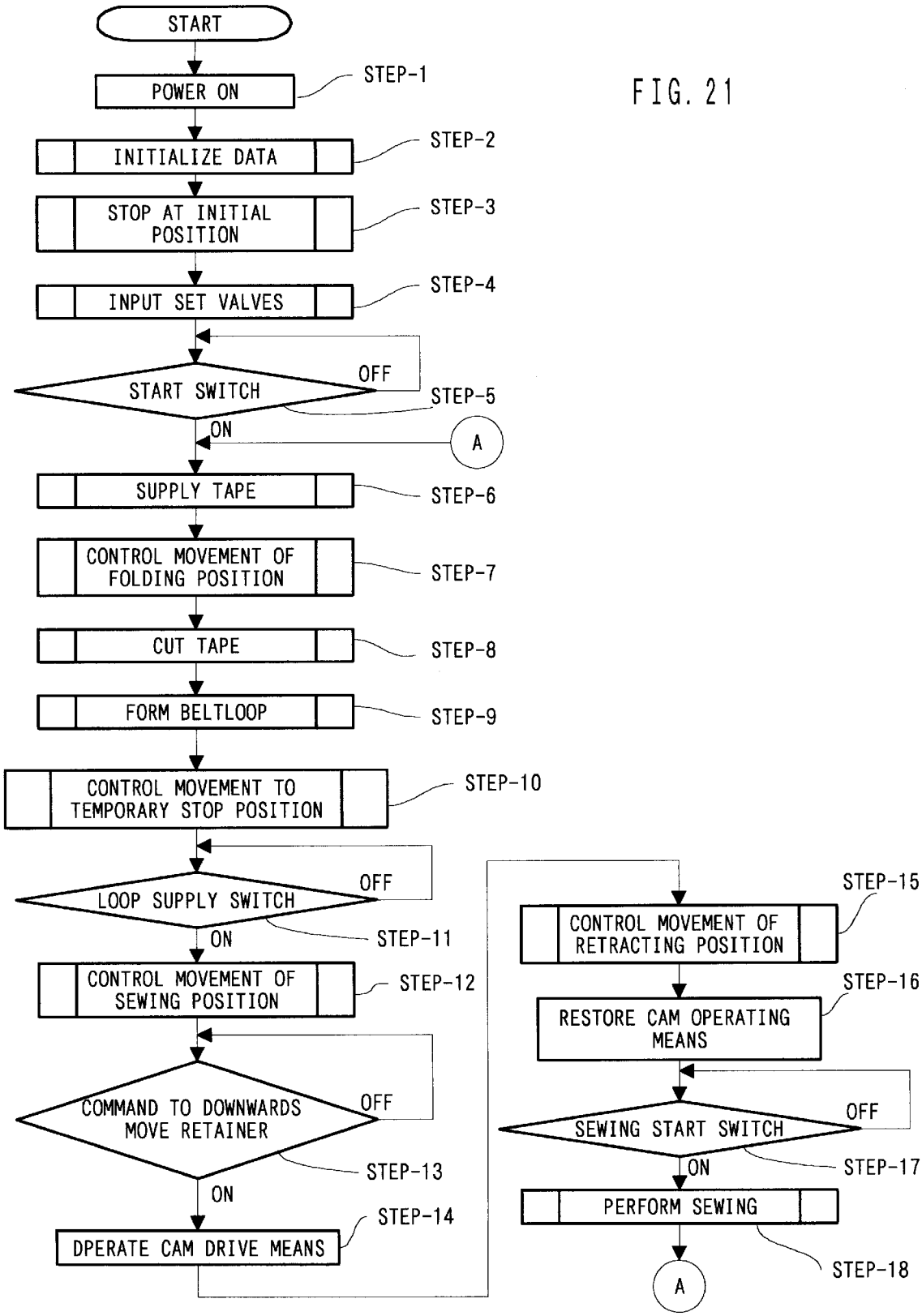
FIG. 21 shows a flow chart of the operation of the belt-loop sewing machine according to the embodiment.

The operation of this embodiment structured as described above will now be described with reference to FIGS. 19 and 21.

Initially, the elements of the belt-loop sewing machine 25 are adjusted to be adaptable to the length of the belt loop 27.

To form a required belt loop 27, the unit guide 85 is moved in the tape feed direction to position the tape delivering means 37 and the tape cutting means 34 so that the distance between the tape support units 130*a* and 130*b* and that between the front bending shaft 200*a* and the rear being shaft 200*b* are adjusted.

All of the parts of the tape delivering means 37 are joined to the joining bracket 70 so that the tape delivering means 37 is formed into a unit. The joining bracket 70 is joined to the unit guide 85 which is joined to the unit joining portion 92 such that the position of the unit guide 85 can be adjusted. When the position is adjusted, the fixing screws 88 are loosened to cause the guide portions 87*a* of the stepped screws 87 to be moved in the elongated holes 85*a* so as to move the unit guide 85 in the tape feed direction. Then, alignment of the position adaptable to the length of the belt loop 27 is performed. Then, the fixing screws 88 is tightened. Thus, the position adjustment is completed. The tape cutting means 34 formed into the unit is joined to the joining bracket 70 to which the tape delivering means 37 is joined. Therefore, the position adjustment can easily be performed in a state in which a predetermined distance is always maintained from the tape cutting means 34 to the setting position P1 (see FIG. 1) which is the position of contact between the delivering roller 40 of the tape delivering means 37 and the loose roll 53.

The distance between the tape support units 130*a* and 130*b* is adjusted by loosening the fixing screws 154A and 154B to move the rear tape support unit 130*b*. At this time, the elongated groove-shape openings 147*a* and 147*b* are able to maintain a predetermined height of the front tape support unit 130*a* during the movement. The elongated groove opening 147*c* is able to always maintain a predetermined height of the tape receiving surface 135 of the front tape support unit 130*a* which is being moved, the height being a height in the lengthwise direction of the tape 12. The tape support means 33 is structured to be movable in such a manner that the rear tape support unit 130*b* of the tape support units 130*a* and 130*b* is secured to the movable base 157 and the front tape support unit 130*a* is brought close to the rear tape support unit 130*b* and moved away from the same.

That is, one distance adjustment means 162 is able to easily and adequately adjust the distance between the tape support units 130*a* and 130*b*.

The adjustment of the position of the fullness forming unit 176 is performed by loosening the two fullness-unit fixing screws 186. At this time, the fullness forming unit 176 is moved substantially in parallel with the lengthwise direction of the tape 12 owing to the elongated groove guide holes 185 which serve as the fullness-unit-movement-locus limiting means. Therefore, the adjustment of the position can easily and adequately be performed. Note that the fullness forming unit 176 can be attached/detached at the disposed position according to whether or not the fullness is formed.

Moreover, adjustments of the machine body 2 including locating of the two presser feet 10 of the machine body 2 are performed.

After the adjustment of the apparatus adaptable to the length of the belt loop 27 has been completed, the power switch (not shown) provided for the operation panel (not shown) is switched on so as to supply electric power (STEP-1) to the belt-loop sewing machine 25. Then, an initializing operation is performed (STEP-2) in accordance with the predetermined program stored in the memory 282 of the control means 48.

When the initializing operation is performed, the paired gripping arms 101 are moved forwards so that the forward-position detecting sensor 83 detects the forward position detector 84. Then, a detection signal is stored (memorized) in the memory 282 of the control means 48. Then the paired gripping arms 101 are moved rearwards so that the rearward-position detecting sensor 120 detects the rearward-position detector 121. Then, a detection signal is stored (memorized) in the memory 282 of the control means 48. The position at which the forward-position detecting sensor 83 detects the forward position detector 84 is the gripping position P3, as shown in FIG. 19. The position at which the rearward-position detector 121 is the belt-loop forming position P4, as shown in FIG. 19.

After the initializing operation of the belt-loop sewing machine 25 has been completed, the control command is output from the control means 48 to each element so that the machine 25 stops at an initial position. (STEP-3). The paired gripping arms 101 constituting a portion of the tape drawing means 38 of the tape supply means 32 stays at an operation reference position (see FIG. 19) in the rear of the belt-loop forming position P4 for a predetermined distance. Moreover, the movable blade 72 of the tape cutting means 34 stays at an upper position. The bending shaft 200 of the loop supply means 35 stays at the retracting position P5 (see FIG. 1). Thereafter, the bending shaft 200 is moved to a standby position on the forward movement locus GML, where the cam plate 221 has been swung clockwise around the rotation pivot RP to cause each fork 202 to move upwards. In addition, each fork 202 of the bending shaft 200 of the loop supply means 35 is allowed to face vertically and stopped. A state in which each of the tape support units 130 and the fullness forming unit 176 are at the lower position is maintained. The downward movements of each of the tape support units 130 and the fullness forming unit 176 are totally performed by moving downwards the movable base 157. Moreover, a state in which the guide rod 137 of the tape pushing and holding means 142 and the contact member 140 are at the upper position is maintained. A state in which the movement guide 263 is stopped at the rearward position indicated with a solid line shown in FIG. 17 is maintained.

Then, the operator operates the operation panel to input set values including the thickness of the tape 12 required for the sewing operation, whether or not the fullness is formed, the size of the fullness if the fullness is formed and the number of the belt loops 27 which will be sewed on the sewed product S (STEP-4).

Thus, the thickness of the tape 12, whether or not the fullness is formed and the number of the belt loops 27 which will be sewed on the sewed product S are stored in the memory 282. When the size of the fullness has been input in the case of forming the fullness, the program stored in the memory 282 of the control means 48 calculates the length of the tape 12 required to form the fullness. Moreover, the program calculates the number of steps, which determines the amount of rotations of the tape delivering motor 44, for obtaining the length of the tape 12 to form the fullness, and stores the number of steps in the memory 282.

Then, the tape reel 251 around which the tape 12 has been would is placed on the two side walls of the sewing table 30 or the accommodating box 252 accommodating the tape 12 is placed on a predetermined position in the lower portion in the sewing table 30.

As shown in FIGS. 16 and 17 and explained before, the operator guides the tape 12 from the tape reel 251 or the accommodating box 252 to the setting position P1.

Then, the start switch (not shown) is switched on so that the operation for supplying the tape 12 is started (STEP-5).

After the operation for supplying the tape 12 has been started (STEP-6), the control command for each element is output from the control means 48. The movement guide 263 of the tape forcibly drawing means is moved forwards so that a looseness required to form the belt loop 27 is provided for the tape 12. After the looseness has been provided for the tape 12, the tape drawing motor 117 moves forward the opened paired gripping arms 101 of the tape drawing means 38 located at the operation reference position at the retracted end, as shown in FIG. 19, and moves the same to the gripping position P3. Then, the paired gripping arms 101 are stopped. The movement of the paired gripping arms 101 to the gripping position P3 and stoppage of the same are performed in accordance with information about the gripping position P3 stored in the memory 282 when the initializing operation has been performed. At this time, whether or not the forward position detector 84 is located on the forward-position detecting sensor 83 is checked by the forward-position detecting sensor 83. If the forward position detector 84 is not located on the forward-position detecting sensor 83, the control of the tape drawing motor 117 is corrected in such a manner that the forward position detector 84 is located on the forward-position detecting sensor 83.

The paired gripping arms 101 are stopped at the gripping position P3 by, for example, a method with which the control means 48 stops the rotation of the tape drawing motor 117 when the forward-position detecting sensor 83 has detected the forward position detector 84.

When the paired gripping arms 101 moved forwards, the tape receiving surface 135 of each of the tape support units 130 and the fullness-forming-tape receiving surface 180 of the fullness forming unit 176 are disposed below the movement locus of the gripping arms 101. The tape discharging means 125 (secured to the lower surface of the base 102 of the fixed arm 101*a* of the paired gripping arms 101) is moved with a light contact with the tape receiving surface 135 of the tape support units 130 and the fullness-forming-tape receiving surface 180 of the fullness forming unit 176.

An unnecessary portion of the tape 12 falls in the discharge chute 270 so as to be collected in a collection containing (not shown) or the like through a discharge pipe (not shown) connected to the lower portion of the discharge chute 270. The tape delivering motor 44 rotates the delivering roller 40 to deliver the tape 12 to the gripping position P3.

The paired gripping arms 101 are moved to the gripping position P3 after the time when the tape 12 has been moved to the gripping position P3 by the delivering roller 40. If the timing is set such that both of the gripping arms 101 and the tape 12 reach simultaneously, a cycle time for supplying the tape 12 can be shortened.

When the paired gripping arms 101 and the leading end of the tape 12 have been moved to the gripping position P3, the paired gripping arms 101 are closed. Thus, the two gripping portions 103 and 107 of the paired gripping arms 101 hold the leading end of the tape 12. Further, each fork 202 of the bending shaft 200 of the loop supply means 35 has been stopped with each fork 202 facing vertically.

When the two gripping portions 103 and 107 of the paired gripping arms 101 have held the leading end of the tape 12, the distance from the gripping position P3 to the belt-loop forming position P4 is calculated based on the information about the gripping position P3 and the belt-loop forming position P4 stored in the memory 282, and the tape drawing motor 117 is rotated by a predetermined number of revolutions (by a predetermined number of steps) for drawing the tape 12 for a predetermined quantity (a distance). Simultaneously, also the tape delivering motor 44 is rotated by a predetermined number of revolutions (by a predetermined number of steps) based on the result of the calculation so that the tape 12 is delivered in a predetermined quantity. This, the tape 12 in the predetermined quantity can be reliably delivered. If the rearward-position detector 121 is not detected by the rearward-position detecting sensor 120 after the drive of the predetermined number of steps, the number of steps is corrected to cause the motors to be driven until detected.

At a moment of time at which the paired gripping arms 101 have been moved rearwards beyond the tape receiving surface 135 of the rear tape support unit 130*b*, the movable base 157 is moved upwards. When the paired gripping arms 101 are moved to the belt-loop forming position P4, the tape 12 is, from a lower position, supported by each tape receiving surface 135 and the fullness-forming-tape receiving surface 180 of the fullness forming unit 176.

When the leading end of the tape 12 has been moved to the belt-loop forming position P4, the control command output form the control means 48 causes the moving drive means 214 to be activated. Thus, the bending shaft 200 is moved from the retracting position P5 to the loop folding position P6. When the folding-position sensor 236 detects the bending shaft 200, the bending shaft 200 is stopped at the loop folding position P6. The movement locus of the leading ends of the forks 202 when moved from the retracting position P5 to the loop folding position P6, that is, the movement locus of the belt loop 27 in the vertical direction is regulated to the rearward movement locus GML owing to the shape of the cam groove 220.

With this movement, the two lengthwise-directional ends of the tape 12 located at the belt-loop forming position P4 are held between the paired pins 201 which constitute the fork 202 of the bending shaft stopped at the loop folding position P6 (STEP-7).

Then, the control command is output from the control means 48 so that the guide rod 137 of the tape pushing and holding means 142 and the contact member 140 are moved downwards. Thus, the guide rod 137 brings the right-hand edge of the tape 12 shown in the right-hand portion of FIG. 1 into contact with the outer surface of the positioning screw 136. Then, the tape 12 is positioned and held on the tape receiving surface 135 of the tape support units 130 by the contact member 140. When the fullness is formed, the fullness-forming-tape receiving surface 180 of the fullness forming unit 176 is moved upwards. Then, the positioned tape 12 is held.

Then, the paired gripping arms 101 are opened so as to release the leading end of the tape 12 held by the paired gripping arms 101. Then, the paired gripping arms 101 are moved to the operation reference position so that the cutting drive means 71 vertically moves the movable blade 72 up and down. Then, the knife rotating drive means 78 is operated, and then the movable blade 72 is again vertically moved. Thus, the base portion of the tape 12 is cut at the cutting position P2 to have a V-shape. Thus, a tape piece (the belt loop 27) having a predetermined length is formed (STEP-8).

Then, the front and rear bending shafts 200*a* and 200*b* are rotated by an angular degree of about 270° to cause the paired pins 201 of the forks 202 to be horizontal. Thus, the two end portions of the belt loop 27 are folded back toward the center, and held. Then, the guide rod 137 of the tape pushing and holding means 142 and the contact member 140 are raised. The fullness-forming-tape receiving surface 180 of the fullness forming unit 176 is lowered. Thus, the tape pushing and holding means 142 and the fullness forming unit 176 are restored to the initial state. Now, the belt loop 27 is ready to be supplied to the sewing position P8 at any time (STEP-9).

Then, the moving drive means 214 is activated to move towards the bending shaft 200 so as to move the belt loop 27 held by the forks 202 to the temporary stop position P7 which is in front of the sewing position P8, for example, the position adjacent to the needles of the machine body 2. Thus, the temporarily-stop-position sensor 237 detects the movement (STEP-10).

The movement locus of the leading ends of the forks 202 from the loop folding position P6 to the temporary stop position P7, that is, the locus of the vertical movement of the belt loop 27, is regulated such that the belt loop 27 does not touch the hand of the operator owing to the shape of the cam groove 220.

Note that the temporary stop position P7 may be a position above the side edge of the needle plate 9 of the machine body 2.

After the belt loop 27 has been moved to the temporary stop position P7, the body detecting sensor 291 detects the existence of the sewed product S. If the sensor 291 detects the sewed product S, the belt loop 27 is continuously held at the temporary stop position P7 until the operator switches the loop supply switch 290 on.

After the operator has arranged the sewed product S and switched the loop supply switch 290 on (STEP-11), the moving drive means 214 is activated to move forwards the bending shaft 200. Thus, the belt loop 27 is transported to the sewing position P8 under the needles. The sewing-position sensor 238 detects this movement.

In the subsequent cycles, the loop supply switch 290 is automatically switched on if the body detecting sensor 291 does not output a detection signal which represents a fact that the sewed product S does not exist.

In response to the detection signal output from the sewing-position P8 sensor 238, the known presser bar lifter is not energized by the control portion (not shown) of the machine body 2. Thus, the presser feet 10 are lowered so that the two bent ends of the belt loop 27 are pressed against predetermined positions on the sewed product S (STEP-12).

The cam operating drive means 225 is operated to move upwards the output shaft 225*a* in accordance with the control command output from the camposition control portion 230 (STEP-14) at the time when the presser-feet 10 are moved downwards in accordance with the command for performing the downward movement given from the machine body 2 (STEP-13). With this, the cam plate 221 is rotated counterclockwise (see FIG. 15) around the rotation pivot RP. Thus, the bending shaft 200 is held at the forward position on the backward movement locus BML.

Then, the bending shaft 200 is retracted so that the forks 202 are drawn from the two bent portions of the pressed belt loop 27 so as to follow the backward movement locus BML toward the retracting position P5 (STEP-15). When the retracting-position sensor 235 detects the movement, the cam operating drive means 225 is operated to return the output shaft 225*a,* whereby the cam plate 221 is rotated clockwise (see FIG. 15) around the rotation pivot RP. Thus, the bending shaft 200 is restored to the standby position of the forward movement locus GML (STEP-16).

After the forks 202 have been drawn from the belt loop 27, the operator switches the sewing start switch on (STEP-17). Then, the machine body 2 works so that the needles 7 are vertically reciprocated. As a result, the two bent portions of the belt loop 27 are sewed on the sewed product S. The sewing operation of the machine body 2 is performed such that the needle plate 9 is moved in the XY direction in synchronization with the positions of the needles 7 in accordance with predetermined data about the sewing operation (STEP-18).

During the sewing operation executed by the machine body 2, the belt-loop supply unit 31 is operated. Thus, a parallel operation is performed such that a next belt loop 27 arranged to be used in a next sewing operation and having a predetermined shape in which the two end portions of the tape are held between the leading ends of the bending shaft 200 at the belt-loop forming position P4. Then, the belt loop 27 is moved to the temporary stop position P7 so that the belt loop 27 is ready to be supplied to the sewing position P8 at any time.

If the operator finds incomplete bending of the two ends of the belt loop 27 staying at the temporary stop position P7 as a result of the operation of the bending shaft 200, the operator switches the setback switch (not shown) on so that the bending shaft 200 can return to the retracting position. During the reverse movement of the bending shaft 200 toward the retracting position, the loop discharge member 145 is able to easily and automatically remove the belt loop 27 from the bending shaft 200 so as to discharge the belt loop 27 to the discharge chute 270.

As described above, the tape supply means 32 of the belt-loop sewing machine 25 according to this embodiment is able to deliver and draw the tape 12. As a result, the tape 12 can automatically, reliably and stably be supplied.

The bending-shaft-movement-locus control means 231 of the belt-loop sewing machine 25 according to this embodiment is able to easily differentials the forward movement locus GML through which the bending shaft 200 is traveled to the sewing position P8 from the backward movement locus BML in which the bending shaft 200 is moved apart from the sewing position P8. As a result, interference of the paired bending shafts 200 which follow the backward passage with other moving elements can easily be prevented. The moving elements are exemplified by the tape supply means 32, specifically, the paired gripping arms 101 of the tape delivering means 37, the tape supply means 32, specifically the tape 12 which is supplied to the belt-loop forming position P4 by the delivering roller 40 of the tape delivering means 37. Therefore, for example, an overlapping operation can easily be realized with which the tape 12 is supplied to the belt-loop forming position P4 during the reverse movement of the bending shaft 200 along the backward movement passage. As a result, the cycle time for which the belt loop 27 is supplied to the sewing position P8, specifically, the cycle time for which the belt loop 27 is positioned to the temporary stop position P7 can be shortened, and the belt loops 27 can efficiently be supplied to the sewing position P8.

The bending-shaft-movement-locus control means 231 according to this embodiment (and constituted by the cam follower 206, the cam plate 221, the cam operating means 225 and the cam-position control portion 230 of the belt-loop sewing machine 25) is structured to operate the cam operating drive means 225 serving as the cam moving means with the control by the cam-position control portion 230, thereby automatically moving the position of the cam plate 221. As a result, the forward movement locus GML through which the bending shaft 200 is moved to the sewing position P8 owing to the cam follower 206 which follows along the cam groove 220 formed the cam plate 221 and the backward movement locus BML through which the bending shaft 200 is moved apart from the sewing position P8 can easily be changed.

The cam-position control portion 230 according to this embodiment is able to automatically shift the position of the cam plate 221 by operating the cam operating means 225, which is the cam moving drive means, at two positions which includes the position at which the bending shaft 200 has been located at the sewing position P8. Another position is the position at which the bending shaft 200 is located at an arbitrary position on the route when the bending shaft 200 returns beyond the loop folding position P6 to the retracting position P5. Therefore, the forward movement locus GML through which the bending shaft 200 is moved to the sewing position P8 and the backward movement locus BML through which the bending shaft 200 is moved away from the sewing position P8 can easily and reliably be changed at an appropriate position. As a result, an appropriate and shortest movement locus for the bending shaft 200 can easily be obtained.

The belt-loop sewing machine 25 according to this embodiment is structured such that the movement of the cam plate 221 is performed by the rotation around the rotation pivot RP. Therefore, the structure of the bending-shaft-movement-locus control means 231 can be simplified. Moreover, the position shift of the cam plate 221 can simply and easily be attained. As a result, time for moving the cam plate 221 can be shortened. Thus, the cycle time for which the belt loop 27 is supplied to the sewing position P8 can be shortened, resulting in efficient supply of the belt loops 27 to the sewing position P8.

The cam follower 206 of the belt-loop sewing machine 25 according to this embodiment is so structured as to be made coincide with the rotation pivot RP of the cam plate 221 close to when the bending shaft 200 is positioned to the sewing position P8. Therefore, position the change of the bending shaft 200 can be small, the bending shaft 200 taking different movement locus when it travels between the retracting position P5 and the sewing position P8 forward and backward. As a result, the necessity of moving other moving elements can be eliminated when the bending shaft 200 returns through the rearward passage. The moving elements are exemplified by the tape supply means 32, specifically the paired gripping arms 101 of the tape drawing means 38 and the tape 12 which is supplied to the belt-loop forming position P4 by the tape supply means 32, specifically the delivering roller 40 of the tape delivering means 37. As a result, the structure of the apparatus can be simplified. Moreover, the position of the cam plate 221 can simply and easily be shifted. Therefore, time for moving the cam plate 221 can be shortened. As a result, the cycle time for supplying the belt loop 27 to the sewing position P8 can be shortened, resulting in the efficient supply of the belt loops 27 to the sewing position P8.

It is to be understood that the present invention is not limited to the above-described embodiment, and that various changes and modifications may be made by those of ordinary skill in the art.

DESCRIPTION OF THE REFERENCE NUMERALS

| | |
|---|---|
| 2 | machine body |
| 12 | tape |
| 25 | belt-loop sewing machine |
| 27 | belt loop |
| 30 | sewing table |
| 31 | belt-loop supply unit |
| 32 | tape supply means |
| 33 | tape support means |
| 34 | tape cutting means |
| 35 | loop supply means |
| 37 | tape delivering means |
| 38 | tape drawing means |
| 40 | delivering roller |
| 48 | control means |
| 53 | loose roll |
| 70 | joining bracket |
| 72 | movable blade |
| 73 | fixed blade |
| 78 | knife rotating drive means |
| 79 | cutting electromagnetic valve |
| 80 | knife electromagnetic valve |
| 83 | forward-position detecting sensor |
| 84 | forward position detector |
| 85 | unit guide |
| 90 | base |
| 91 | joining base |
| 92 | unit joining portion |
| 101 | paired gripping arms |
| 101a | fixed arm |
| 101b | movable arm |
| 110 | air cylinder (opening/closing drive means) |
| 111 | opening/closing electromagnetic value |
| 117 | tape drawing motor |
| 120 | rearward-position detecting sensor |
| 121 | rearward-position detector |
| 125 | tape discharging means |
| 130 | tape support unit |
| 130a | front tape support unit |
| 130b | rear tape support unit |
| 135 | tape receiving surface |
| 136 | positioning screw |
| 137 | guide rod |
| 140 | contact member |
| 141 | tape pushing and holding drive means |
| 142 | tape pushing and holding means |
| 144 | tape pushing and holding electromagnetic valve |
| 145 | loop discharge member |
| 157 | movable base |

-continued

| DESCRIPTION OF THE REFERENCE NUMERALS | |
|---|---|
| 160 | height limiting means |
| 161 | attitude control means |
| 162 | distance adjustment means |
| 166 | fixed plate |
| 172 | movable-base drive means |
| 173 | movable-base electromagnetic valve |
| 176 | fullness forming unit |
| 180 | fullness-forming-tape receiving surface |
| 184 | fullness forming drive means |
| 185 | elongated groove guide holes |
| 187 | fullness forming electromagnetic valve |
| 200 | bending shaft |
| 200a | front bending shaft |
| 200b | rear bending shaft |
| 201 | pin |
| 202 | fork |
| 203a, 203b | bending drive means |
| 204a, 204b | bending electromagnetic valve |
| 206 | cam follower |
| 214 | bending-shaft moving drive means |
| 221 | cam plate |
| 225 | cam drive means |
| 226 | cam electromagnetic valve |
| 230 | cam-position control portion |
| 231 | bending-shaft-movement-locus control means |
| 251 | tape reel |
| 252 | accommodating box |
| 263 | movement guide |
| 265 | movement guide drive means |
| 266 | movement-guide electromagnetic valve |
| 281 | CPU |
| 282 | memory |
| 283 | I/O interface |
| B | supplying direction (for tape) |
| S | sewed product |
| OS | operator side |
| BS | back side |
| RP | rotation pivot (of cam) |
| GML | forward movement locus (of bending shaft fork) |
| BML | backward movement locus (of bending shaft fork) |

What is claimed is:

1. A belt-loop sewing machine having a belt-loop supply unit structured to cut an elongated tape into sectioned tapes, each having a predetermined length, and incorporating paired forks which fold back the two ends of the sectioned tape toward the center of the tape to form and hold a belt loop so as to supply the belt loop held by the forks to a sewing position so that the two folded portions of the belt-loop are sewn on a workpiece at the sewing position, said belt-loop sewing machine comprising:

movement-locus control means for controlling the movement locus of said forks such that a forward movement locus of said forks which move from a retracting position to the sewing position via a belt-loop forming position and backward movement locus of said forks which move from the sewing position to the retracting position are different from each other.

2. A belt-loop sewing machine according to claim 1, wherein said movement-locus control means comprises, a regulating member for regulating the movement locus of said forks, drive means for displacing said regulating member, and control means for driving said drive means to displace said regulating member during the forward and backward movements of said forks.

3. A belt-loop sewing machine according to claim 2, wherein said regulating member includes a cam for guiding the movement of said forks.

4. A belt-loop sewing machine according to claim 1, wherein the backward movement locus of said forks is a movement locus for bypassing the belt-loop forming position.

5. A belt-loop sewing machine having a belt-loop supply unit structured to cut an elongated tape into sectioned tapes each having a predetermined length and having paired forks which fold back the two ends of the sectioned tape toward the center of the tape to form and hold a belt loop so as to transport the belt loop held by the forks to a sewing position so that the belt loop is sewn on a sewed product at the sewing position, said belt-loop sewing machine comprising:

means connected to said forks to regulate a forward movement locus of said forks from a retracting position to the sewing position via a belt-loop forming position and to regulate a backward movement locus of said forks from the sewing position to the retracting position wherein the backward movement locus of said forks is a movement locus for bypassing the belt-loop forming position.

6. A belt-loop sewing machine having a belt-loop supply unit structured to cut an elongated tape into sectioned tapes each having a predetermined length and having a pair of forks which fold back the two ends of the tape toward the middle of the tape to form and hold a belt loop so as to move the belt loop held by the forks to a sewing position so that the belt loop is sewn on a workpiece at the sewing position, said belt-loop sewing machine comprising:

a fork movement control means for moving said forks from a retracting position to the sewing position via a belt-loop forming position, and then moving from the sewing position to a retracting position bypassing the belt-loop forming position.

* * * * *